US012392047B2

(12) United States Patent
Richardson et al.

(10) Patent No.: US 12,392,047 B2
(45) Date of Patent: Aug. 19, 2025

(54) BYPRODUCT REMOVAL FROM ELECTROPLATING SOLUTIONS

(71) Applicant: Lam Research Corporation, Fremont, CA (US)

(72) Inventors: Joseph Richardson, Sherwood, OR (US); Jae Shin, Beaverton, OR (US); Jeyavel Velmurugan, Portland, OR (US); Elizabeth Calora, Beaverton, OR (US); Thomas Anand Ponnuswamy, Sherwood, OR (US); Steven T. Mayer, Aurora, OR (US)

(73) Assignee: Lam Research Corporation, Fremont, CA (US)

( * ) Notice: Subject to any disclaimer, the term of this patent is extended or adjusted under 35 U.S.C. 154(b) by 384 days.

(21) Appl. No.: 17/596,929

(22) PCT Filed: Jun. 23, 2020

(86) PCT No.: PCT/US2020/039083
§ 371 (c)(1),
(2) Date: Dec. 21, 2021

(87) PCT Pub. No.: WO2020/263795
PCT Pub. Date: Dec. 30, 2020

(65) Prior Publication Data

US 2022/0307152 A1 Sep. 29, 2022

Related U.S. Application Data

(60) Provisional application No. 62/868,744, filed on Jun. 28, 2019.

(51) Int. Cl.

| | |
|---|---|
| ***C25D 7/12*** | (2006.01) |
| ***C25D 3/38*** | (2006.01) |
| ***C25D 5/56*** | (2006.01) |

(52) U.S. Cl.
CPC ..... *C25D 7/12* (2013.01); *C25D 3/38* (2013.01); *C25D 5/56* (2013.01)

(58) Field of Classification Search
None
See application file for complete search history.

(56) References Cited

U.S. PATENT DOCUMENTS 1,255,395 A 2/1918 Duram
2,432,973 A 12/1947 Smedberg
(Continued)

FOREIGN PATENT DOCUMENTS

CN 1351197 A 5/2002
CN 1609281 A 4/2005
(Continued)

OTHER PUBLICATIONS

English translation JP4575401 (Year: 2010).*
(Continued)

*Primary Examiner* — Stefanie S Wittenberg
(74) *Attorney, Agent, or Firm* — Weaver Austin Villeneuve & Sampson LLP

(57) ABSTRACT

Systems and methods for electroplating are provided. An electroplating system may include an electroplating cell configured to contain an anode and an electroplating solution, a wafer holder configured to support a wafer within the electroplating cell, a reservoir configured to contain at least a portion of the electroplating solution, a recirculation flowpath that fluidically connects the reservoir and the electroplating cell, in which the recirculation flowpath includes a pump and is configured to circulate the electroplating solution between the reservoir and the electroplating cell, and a frother fluidically connected to one or more of the electroplating cell, the reservoir, and the recirculation flowpath. The frother may be configured to generate bubbles in
(Continued)

the electroplating solution when the electroplating solution is present in the electroplating system, interfaced with the frother, and the frother is activated.

22 Claims, 13 Drawing Sheets

(56) References Cited

U.S. PATENT DOCUMENTS

| | | | | |
|---|---|---|---|---|
| 6,391,209 | B1 | 5/2002 | Belongia et al. | |
| 6,527,920 | B1 | 3/2003 | Mayer et al. | |
| 6,551,487 | B1 | 4/2003 | Reid et al. | |
| 6,582,580 | B1 | 6/2003 | Hongo et al. | |
| 6,773,571 | B1 | 8/2004 | Mayer et al. | |
| 6,800,187 | B1 | 10/2004 | Reid et al. | |
| 6,821,407 | B1 | 11/2004 | Reid et al. | |
| 8,262,871 | B1 | 9/2012 | Mayer et al. | |
| 8,308,931 | B2 | 11/2012 | Reid et al. | |
| 9,567,685 | B2 | 2/2017 | Kagajwala et al. | |
| 9,617,652 | B2 | 4/2017 | Abraham et al. | |
| 10,208,395 | B2 | 2/2019 | Abraham et al. | |
| 11,001,934 | B2 | 5/2021 | Banik, II et al. | |
| 11,585,007 | B2 | 2/2023 | Banik, II et al. | |
| 12,157,949 | B2 | 12/2024 | Banik, II et al. | |
| 2002/0027080 | A1 | 3/2002 | Yoshioka et al. | |
| 2002/0195352 | A1 | 12/2002 | Mayer et al. | |
| 2003/0217929 | A1 | 11/2003 | Peace | |
| 2004/0025248 | A1 | 2/2004 | Lang et al. | |
| 2005/0082163 | A1 | 4/2005 | Yoshioka et al. | |
| 2009/0026083 | A1* | 1/2009 | Tachibana | C25D 21/18 205/101 |
| 2010/0032310 | A1 | 2/2010 | Reid et al. | |
| 2011/0083965 | A1 | 4/2011 | Reid et al. | |
| 2014/0165476 | A1 | 6/2014 | Can et al. | |
| 2014/0166476 | A1 | 6/2014 | Abraham et al. | |
| 2016/0265132 | A1 | 9/2016 | Graham et al. | |
| 2017/0058417 | A1 | 3/2017 | Graham et al. | |
| 2017/0167045 | A1 | 6/2017 | Abraham et al. | |
| 2017/0342590 | A1 | 11/2017 | Thorkelsson et al. | |
| 2018/0016699 | A1* | 1/2018 | Arvin | C25D 21/14 |
| 2021/0395913 | A1 | 12/2021 | Banik, II et al. | |
| 2023/0175162 | A1 | 6/2023 | Banik, II et al. | |
| 2025/0051953 | A1 | 2/2025 | Banik, II et al. | |

FOREIGN PATENT DOCUMENTS

| | | | |
|---|---|---|---|
| CN | 101363127 | A | 2/2009 |
| CN | 101407935 | A | 4/2009 |
| CN | 103866365 | A | 6/2014 |
| CN | 106480481 | A | 3/2017 |
| CN | 106947997 | A | 7/2017 |
| CN | 107419312 | A | 12/2017 |
| JP | H02122098 | A | 5/1990 |
| JP | H0456799 | A | 2/1992 |
| JP | 2004143478 | A | 5/2004 |
| JP | 2004250785 | A | 9/2004 |
| JP | 2008527173 | A | 7/2008 |
| JP | 2009517543 | A | 4/2009 |
| JP | 4575401 | B2 | 11/2010 |
| JP | 4957906 | B2 | 6/2012 |
| KR | 20010090469 | A | 10/2001 |
| KR | 20020032782 | A | 5/2002 |
| KR | 20100047161 | A | 5/2010 |
| TW | I281516 | B | 5/2007 |
| TW | 201204877 | A | 2/2012 |
| TW | 201742956 | A | 12/2017 |
| WO | WO-0168952 | A1 | 9/2001 |
| WO | WO-2006074106 | A2 | 7/2006 |

OTHER PUBLICATIONS

International Preliminary Report on Patentability dated Jan. 6, 2022 in PCT Application No. PCT/US2020/039083.
International Preliminary Report on Patentability dated Jun. 3, 2021 issued in Application No. PCT/US2019/061853.
International Search Report and Written Opinion dated Oct. 13, 2020, issued in Application No. PCT/US2020/039083.
International Search Report dated Mar. 10, 2020 issued in Application No. PCT/US2019/061853.
Japanese First Office Action dated Feb. 20, 2018 issued in Application No. JP 2013-255654.
Japanese First Office Action dated Sep. 5, 2019 issued in Application No. JP 2018-174852.
Korean Decision For Grant of Patent dated Oct. 16, 2020 issued in Application No. KR 10-2013-0154296.
Korean First Office Action dated Feb. 16, 2021 issued in Application No. KR 10-2021-0006037.
Korean First Office Action dated May 19, 2020 issued in Application No. KR 10-2013-0154296.
Malaysian First Office Action dated Dec. 2, 2019 issued in Application No. MY PI2013004463.
Malaysian Second Office Action dated Aug. 24, 2021 issued in Application No. MY PI2013004463.
Taiwanese First Office Action dated Apr. 26, 2017 issued in Application No. TW 102145643.
Taiwanese First Office Action dated Jun. 25, 2018 issued in Application No. TW 106132517.
U.S. Final Office Action dated Aug. 26, 2016 issued in U.S. Appl. No. 14/102,220.
U.S. Notice of Allowance dated Dec. 7, 2016 issued in U.S. Appl. No. 14/102,220.
U.S. Notice of Allowance dated Oct. 10, 2018 issued in U.S. Appl. No. 15/442,519.
U.S. Office Action dated Dec. 16, 2015 issued in U.S. Appl. No. 14/102,220.
U.S. Office Action dated Feb. 18, 2022 issued in U.S. Appl. No. 17/309,214.
U.S. Office Action dated Jan. 26, 2018 issued in U.S. Appl. No. 15/442,519.
CN Office Action dated Dec. 5, 2023 in CN Application No. 201980076026.5 with English translation.
CN Office Action dated Dec. 21, 2023 in CN Application No. 202080061144.1 with English translation.
Drenckhan-Andreatta W., et al., "The Science of Foaming," Advances in Colloid and Interface Science, 2015, vol. 222, pp. 228-259.
Schramm L.L., et al., "Foams: Basic Principles," Advances in Chemistry, Oct. 1994, vol. 242(1), pp. 03-45.
TW Office Action dated Jul. 31, 2023, in application No. TW108141736 with English Translation.
U.S. Notice of Allowance dated Oct. 19, 2022 in U.S. Appl. No. 17/309,214.
U.S. Corrected Notice of Allowance dated Jan. 9, 2023 in U.S. Appl. No. 17/309,214.
U.S. Final office Action dated Jul. 7, 2022 in U.S. Appl. No. 17/309,214.
U.S. Non-Final Office Action dated Mar. 14, 2024 in U.S. Appl. No. 18/155,238.
U.S. Restriction Requirement dated Dec. 27, 2023 in U.S. Appl. No. 18/155,238.
U.S. Corrected Notice of Allowance dated Sep. 5, 2024 in U.S. Appl. No. 18/155,238.
U.S. Notice of Allowance dated Jul. 23, 2024 in U.S. Appl. No. 18/155,238.
U.S. Appl. No. 18/922,805, inventors Banik II S.J, et al., filed Oct. 22, 2024.
KR Office Action dated Feb. 4, 2025 in KR Application No. 10-2021-7019029, with English Translation.

* cited by examiner

BYPRODUCT REMOVAL FROM ELECTROPLATING SOLUTIONS

INCORPORATION BY REFERENCE

A PCT Request Form is filed concurrently with this specification as part of the present application. Each application that the present application claims benefit of or priority to as identified in the concurrently filed PCT Request Form is incorporated by reference herein in their entireties and for all purposes.

BACKGROUND

Electrochemical deposition processing is widely used in the semiconductor industry for metallization of integrated circuit manufacturing. One such application is copper (Cu) electrochemical deposition, which may involve depositing of Cu lines into the trenches and/or vias that are pre-formed in dielectric layers. In this process, a thin adherent metal diffusion-barrier film is pre-deposited onto the surface using physical vapor deposition (PVD) or chemical vapor deposition (CVD). A thin copper seed layer will then be deposited on top of the barrier layer, typically by a PVD deposition process. The features (vias and trenches) are then filled electrochemically with Cu through an electrochemical deposition process, during which the copper anion is reduced electrochemically to copper metal.

SUMMARY

Details of one or more implementations of the subject matter described in this specification are set forth in the accompanying drawings and the description below. Other features, aspects, and advantages will become apparent from the description, the drawings, and the claims. The following, non-limiting implementations are considered part of the disclosure; other implementations will be evident from the entirety of this disclosure and the accompanying drawings as well.

In some embodiments, an electroplating system may be provided. The electroplating system may include an electroplating cell configured to contain an anode and an electroplating solution, a wafer holder configured to support a wafer within the electroplating cell, a reservoir configured to contain at least a portion of the electroplating solution, a recirculation flowpath that fluidically connects the reservoir and the electroplating cell, and the recirculation flowpath includes a pump and is configured to circulate the electroplating solution between the reservoir and the electroplating cell, and a frother fluidically connected to one or more of the electroplating cell, the reservoir, and the recirculation flowpath, wherein the frother is configured to generate bubbles in the electroplating solution when the electroplating solution is present in the electroplating system, interfaced with the frother, and the frother is activated.

In some embodiments, the frother may include at least one of an aeration stone, one or more jets, one or more nozzles, a propeller, or an impeller.

In any of the above embodiments, the frother may include the aeration stone, and the aeration stone may be comprised of a material compatible with the electroplating solution.

In any of the above embodiments, the material may include one or more of a high-density polyethylene (HDPE), a polypropylene (PP), and polytetrafluoroethylene (PTFE).

In any of the above embodiments, the porosity of the material may be between about 1 millimeter and about 1 micron.

In any of the above embodiments, the electroplating system may further include a gas source fluidically connected to the frother and configured to flow a gas to the aeration stone.

In any of the above embodiments, the electroplating system may further include a container, and the container may be fluidically connected to one or more of the electroplating cell, the reservoir, or the recirculation flowpath, and the container may be configured to receive and hold a first volume of the electroplating solution. The frother may be further configured to generate bubbles in the electroplating solution in the container when the container holds the first volume of electroplating solution and the frother is activated.

In any of the above embodiments, the electroplating system may further include a foam generating unit that includes the container and the frother, and the foam generating unit may be fluidically connected to one or more of the electroplating cell, the reservoir, or the recirculation flowpath.

In any of the above embodiments, the container may be physically separate from, but fluidically connected to, one or more of the electroplating cell, the reservoir, or the recirculation flowpath.

In any of the above embodiments, the container may be at least partially positioned in one of the electroplating cell, the reservoir, or the recirculation flowpath.

In any of the above embodiments, the container may be fluidically interposed between the electroplating cell and the reservoir.

In any of the above embodiments, the container may further include a foam exit port configured to allow a foam in the container to exit the container through the foam exit port.

In any of the above embodiments, the container may include a fluid outlet, and the foam exit port may be higher in elevation than the fluid outlet.

In any of the above embodiments, the container may include a fluid inlet, and the foam exit port may be higher in elevation than the fluid inlet.

In any of the above embodiments, the electroplating system may further include a foam movement unit configured to cause a foam in the container to exit the container when the foam is in the container and when the foam movement unit is activated.

In any of the above embodiments, the foam movement unit includes one or more of a fan, a skimmer, and a vacuum pump.

In any of the above embodiments, the electroplating system may further include a controller configured to control the frother, and the controller comprises control logic for causing the electroplating solution to flow into the container and be held by the container, and causing the frother generate bubbles in the electroplating solution held in the container.

In any of the above embodiments, the electroplating system may further include one or more inlet valves configured to control flow of the electroplating solution into the container. The controller may be further configured to control the one or more inlet valves, and the controller may further include control logic for causing the one or more inlet valves to open to allow the electroplating solution to flow into the container.

In any of the above embodiments, the system may be further configured such that the electroplating solution flows into and out of the container through a common flowpath, the one or more inlet valves may be configured to control flow of the electroplating solution into the container through the common flowpath, the one or more inlet valves may be further configured to also control flow of the electroplating solution out of the container through the common flowpath, and the controller may further comprise control logic for causing the one or more inlet valves to close to allow the container to hold the electroplating solution in the container.

In any of the above embodiments, the electroplating system may further include one or more outlet valves configured to control flow of the electroplating solution out of the container. The controller may be further configured to control the one or more outlet valves, and the controller may further comprise control logic for causing the one or more outlet valves to close to allow the container to hold the electroplating solution in the container, and causing the one or more outlet valves to open to allow the electroplating solution to flow out the container.

In any of the above embodiments, the electroplating system may be configured to hold a total working volume of electroplating solution, and the container may be configured to hold up to 5% of the total working volume of electroplating solution.

In any of the above embodiments, the electroplating system may further include a controller configured to control the frother, and the controller may comprise control logic for causing the frother to generate bubbles in the electroplating solution during one or more time periods when the electroplating solution is present in the electroplating system and interfaced with the frother.

In any of the above embodiments, the controller may further comprise control logic for causing the frother to generate bubbles in the electroplating solution when the electroplating solution is present in the electroplating system and interfaced with the frother for a first time period, and causing the frother to repeat the generation of bubbles at a first time interval.

In any of the above embodiments, the electroplating system may further include a power supply electrically connected to the wafer holder and the electroplating cell. The power supply may be configured to apply a voltage to a wafer held by the wafer holder, and the controller further comprises control logic for causing the power supply to apply a current to a wafer held by the wafer holder and the electroplating cell, and measuring the voltage potential between the wafer and the electroplating cell. The causing the frother to generate bubbles in the electroplating solution may be further based, at least in part, on the measured voltage.

In any of the above embodiments, the controller may further comprise control logic for determining a change in the voltage potential between the wafer and the electroplating cell, and the causing the frother to generate bubbles in the electroplating solution may be further based, at least in part, on the determined change in the voltage potential.

In any of the above embodiments, the electroplating system may further include a controller configured to control the frother, and the controller may comprise control logic for causing the frother to continuously generate bubbles in the electroplating solution during electroplating of a wafer.

In some embodiments a method of electroplating may be provided. The method may include providing an electroplating solution to an electroplating system including an electroplating cell configured to contain an anode and an electroplating solution, a wafer holder configured to support a wafer with the electroplating cell, and a reservoir configured to contain at least a portion of the electroplating solution, frothing, using a frother, the electroplating solution by generating bubbles in the electroplating solution and thereby generating a foam, and removing the foam from the electroplating system.

In any of the above embodiments, the frothing may reduce an amount of levelers from the electroplating solution.

In any of the above embodiments, the foam may contain levelers from the electroplating solution.

In any of the above embodiments, the frothing may further comprise flowing a gas to an aeration stone in the frother.

In any of the above embodiments, the gas may comprise nitrogen.

In any of the above embodiments, the frothing may further comprise agitating the electroplating solution with at least one of one or more jets, one or more nozzles, a propeller, and an impeller.

In any of the above embodiments, the method may further include flowing the electroplating solution to a container, in which the frothing occurs in the container, and flowing, after the frothing, the electroplating solution from the container to one or more of the reservoir and the electroplating cell.

In any of the above embodiments, the method may further include holding, during at least the frothing, a first volume of the electroplating solution in the container.

In any of the above embodiments, the method may further include causing, during at least the frothing, a foam generated in the container to flow out of the container.

In any of the above embodiments, the method may further include interfacing the electroplating solution with the frother.

In any of the above embodiments, the method may further include electroplating a wafer, and the frothing and the removing may be performed continuously during the electroplating.

BRIEF DESCRIPTION OF THE DRAWINGS

The various implementations disclosed herein are illustrated by way of example, and not by way of limitation, in the figures of the accompanying drawings, in which like reference numerals refer to similar elements.

DETAILED DESCRIPTION

Figure 1:
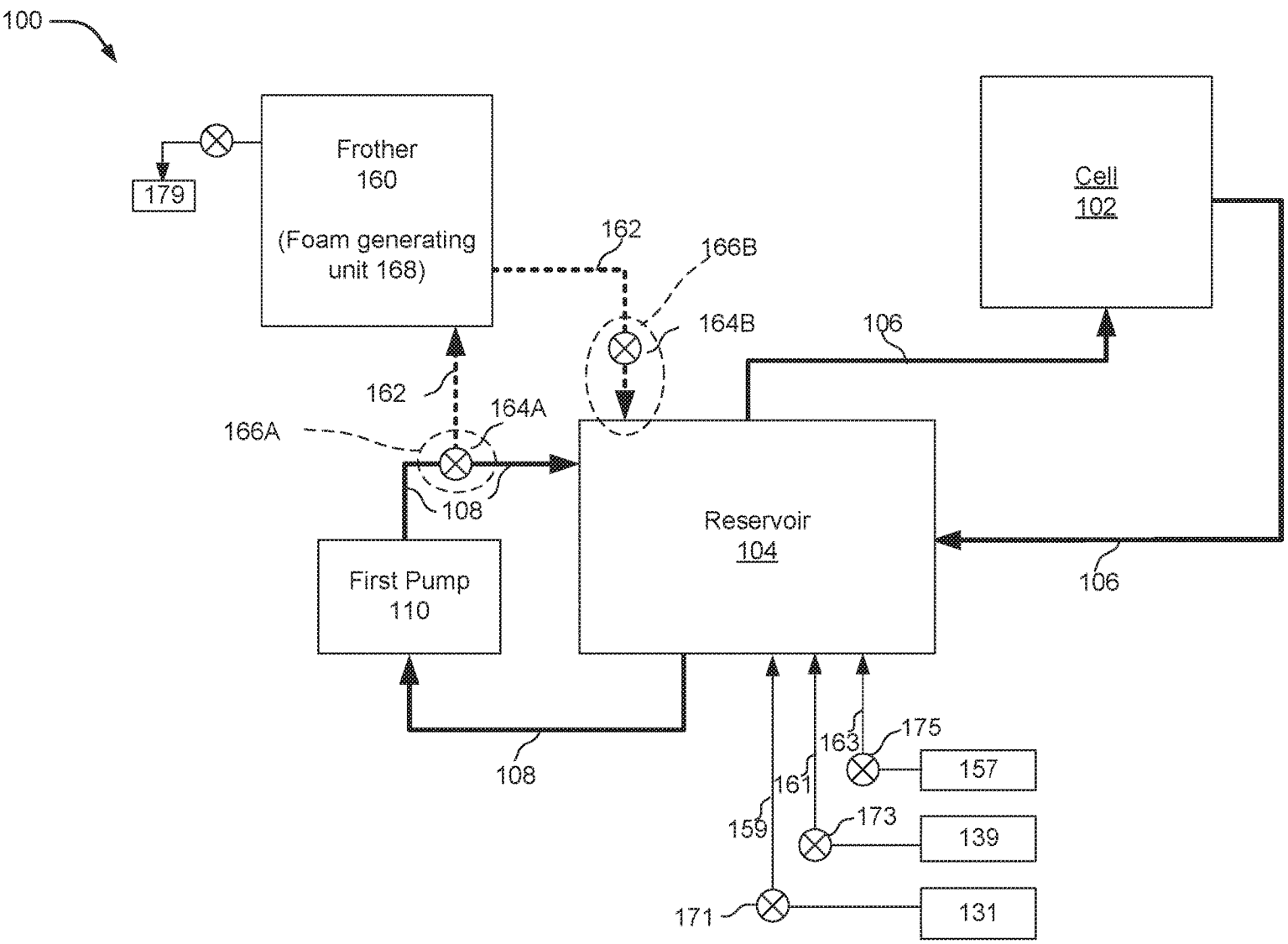
FIG. 1 depicts a first example electroplating system.

In the following description, numerous specific details are set forth in order to provide a thorough understanding of the presented embodiments. The disclosed embodiments may be practiced without some or all of these specific details. In other instances, well-known process operations have not been described in detail to not unnecessarily obscure the disclosed embodiments. While the disclosed embodiments will be described in conjunction with the specific embodiments, it will be understood that it is not intended to limit the disclosed embodiments.

Introduction and Context

Manufacturing of semiconductor devices commonly requires deposition of electrically conductive material on semiconductor wafers. The conductive material, such as copper, is often deposited by electroplating onto a seed layer of metal deposited onto the wafer surface by various methods, such as physical vapor deposition (PVD) or chemical vapor deposition (CVD). Electroplating is generally used for depositing metal into the vias and trenches of the processed wafer during Damascene and dual Damascene processing.

Electroplating is typically performed in an electroplating bath, in which the semiconductor wafer is submerged in an electroplating solution. Over the course of electroplating wafers, various byproducts and other materials are produced in the electroplating solution. In conventional electroplating systems, these byproducts and other materials are generally removed using a "bleed and feed" technique in which the electroplating solution is replenished with fresh solution and the old solution is disposed of or reconstituted. While it is generally desirable to refresh a small percentage of the solution by bleed and feed method, it is not an economically feasible method for some byproducts and other materials.

Electroplating processes and equipment are conventionally performed and designed to minimize and eliminate any bubble formation in the electroplating systems. Many electroplating solution foams have a tendency to dry onto areas of the electroplating system, such as the walls of the reservoir and features of the plating cell, and condense into crystals (copper sulfate tends to crystalize) which can reenter the electroplating solution as unwanted particulate contamination of the system, or can be reintroduced and dissolved into the solution itself, all of which negatively affects the electroplating. Thus, electroplating equipment is typically designed to avoid or minimize the generation of bubbles/foam in the electroplating solution.

Some electroplating processes produce a byproduct in the electroplating solution that negatively affects the electroplating process and removing this byproduct requires high, unacceptable bleed and feed rates to maintain acceptable solution concentration which results in large volumes of solution being wasted which in turn results in a high operation cost of an electroplating apparatus.

Described herein are apparatuses and techniques for removing unwanted chemical components, such as byproducts, from an electroplating solution by frothing the electroplating solution to generate a foam that traps the unwanted component, and then removing this foam to remove the unwanted component from the electroplating solution. These electroplating systems include a frother that produces bubbles at an air-liquid interface as the result of, for instance, agitation and/or aeration. The frother may be an aerator (e.g., an aeration stone) that flows a gas into the electroplating solution to agitate and/or aerate the solution; the frother may also be a propeller, impeller, or a plurality of nozzles or jets. As stated above, this frothing of the electroplating solution is contrary to typical electroplating systems and operations.

Features of Electroplating

Damascene processing is used for forming interconnections on integrated circuits (ICs). It is especially suitable for manufacturing copper interconnections. Damascene processing involves formation of inlaid metal lines in trenches and vias formed in a dielectric layer (inter-metal dielectric). In a typical Damascene process, a pattern of trenches and vias is etched in the dielectric layer of a semiconductor wafer substrate. A thin layer of diffusion-barrier film such as tantalum, tantalum nitride, or a TaN/Ta bilayer is then deposited onto the wafer surface by a PVD method, followed by deposition of seed layer of copper on top of the diffusion-barrier layer. The trenches and vias are then electrofilled with copper, and the surface of the wafer is planarized to remove excess copper.

The vias and trenches are electrofilled in an electroplating apparatus which may include a cathode and an anode immersed into an electroplating solution containing electrolytes in the plating vessel. The cathode of this apparatus is the wafer itself, or more specifically, its copper seed layer and, over time, the deposited copper layer. The anode may be a disc composed of, e.g., phosphorus-doped copper. The composition of electrolyte that is used for deposition of copper may vary, but usually includes sulfuric acid, copper salt (e.g. $CuSO4$), chloride ions, and a mixture of organic additives. The electrodes are connected to a power supply, which provides the necessary voltage to electrochemically reduce cupric ions at the cathode, resulting in deposition of copper metal on the surface of the wafer seed layer.

The composition of electroplating solution is selected so as to optimize the rates and uniformity of electroplating. During the plating process, copper salt serves as the source of copper cation, and also provides conductivity to the electroplating solution; further, in certain embodiments, sulfuric acid enhances electroplating solution conductivity by providing hydrogen ions as charge carriers. Also, organic additives, generally known in the art as accelerators, suppressors, or levelers, are capable of selectively enhancing or suppressing rate of copper (Cu) deposition on different surfaces and wafer features. Chloride (Cl) ion is useful for modulating the effect of organic additives, and may be added to the electroplating bath for the purpose. In some implementations, another halide (e.g., bromide or iodide) is used in place of or in addition to chloride.

While not wishing to be bound by any theory or mechanism of action, it is believed that levelers (either alone or in combination with other bath additives) act as suppressing agents, in some cases to counteract the depolarization effect associated with accelerators, especially in exposed portions of a substrate, such as the field region of a wafer being processed, and at the side walls of a feature. The leveler may locally increase the polarization/surface resistance of the substrate, thereby slowing the local electrodeposition reaction in regions where the leveler is present. The local concentration of levelers is determined to some degree by mass transport. Therefore, levelers act principally on surface structures having geometries that protrude away from the surface. This action "smooths" the surface of the electrodeposited layer. It is believed that in many cases the leveler reacts or is consumed at the substrate surface at a rate that is at or near a diffusion limited rate, and therefore, a continuous supply of leveler is often beneficial in maintaining uniform plating conditions over time.

Leveler compounds are generally classified as levelers based on their electrochemical function and impact and do not require specific chemical structure or formulation. However, levelers often contain one or more nitrogen, amine, imide or imidazole, and may also contain sulfur functional groups. Certain levelers include one or more five and six member rings and/or conjugated organic compound derivatives. Nitrogen groups may form part of the ring structure. In amine-containing levelers, the amines may be primary, secondary or tertiary alkyl amines. Furthermore, the amine may be an aryl amine or a heterocyclic amine. Example amines include, but are not limited to, dialkylamines, trialkylamines, arylalkylamines, triazoles, imidazole, triazole, tetrazole, benzimidazole, benzotriazole, piperidine, morpholines, piperazine, pyridine, oxazole, benzoxazole, pyrimidine, quonoline, and isoquinoline. Imidazole and pyridine may be especially useful. Other examples of levelers include Janus Green B and Prussian Blue. Leveler compounds may also include ethoxide groups. For example, the leveler may include a general backbone similar to that found in polyethylene glycol or polyethyelene oxide, with fragments of amine functionally inserted over the chain (e.g., Janus Green B). Example epoxides include, but are not limited to, epihalohydrins such as epichlorohydrin and epibromohydrin, and polyepoxide compounds. Polyepoxide compounds having two or more epoxide moieties joined together by an ether-containing linkage may be especially useful. Some leveler compounds are polymeric, while others are not. Example polymeric leveler compounds include, but are not limited to, polyethylenimine, polyamidoamines, and reaction products of an amine with various oxygen epoxides or sulfides. One example of a non-polymeric leveler is 6-mercapto-hexanol. Another example leveler is polyvinylpyrrolidone (PVP).

Over the course of electroplating wafers, various byproducts and other materials are produced in the electroplating solution. In conventional electroplating systems, these byproducts and other materials are generally removed using a "bleed and feed" technique in which the electroplating solution is replenished with fresh solution and the old solution is disposed of or reconstituted. While it is generally desirable to refresh a small percentage of the solution by bleed and feed method, it is not an economically feasible method for some byproducts and other materials.

As stated above, it has been found that some electroplating processes produce a byproduct in the electroplating solution that negatively affects the electroplating, but for these processes, the byproduct is produced at high rates which require the use of high and undesirable bleed and feed rates to maintain acceptable solution concentrations. These high bleed and feed rates result in large volumes of solution being wasted. The operation cost of an electroplating apparatus becomes very high when high bleed and feed rates are used. In some examples, as discussed below, conventional bleed and feed rates can result in the removal and disposal of about 10% to 20% of the electroplating solution over a 24 hours of electroplating and in contrast, these high byproduct production rates can result in the removal of about 100% of the electroplating solution over the same 24 hours of electroplating.

Some such processes use an electroplating solution that contains a small amount, or no amount, of intentionally added levelers, but the nature of these electroplating processes, e.g., the wafer configuration, electroplating solution, or chemistry involved, is such that a process byproduct is inherently produced in the solution that is a leveler which adversely affects the electroplating process by, for example, reducing the performance of the electroplating solution, reducing the bump height, and reducing the fill quality. As commonly known in the art, for may electroplating processes, such as through silicon via ("TSV") application, the bump height of a filled via provides an indicator of electroplating performance and electroplating solution degradation caused, in some instances, by the presence of unwanted leveler byproducts. Bump heights are measured with respect to the surface of the wafer such that, for example, a bump height of 4 micrometers (μm) is a via filled 4 μm above the surface of the wafer. As the leveler byproducts accumulate in the electroplating solution during electroplating of one or more wafers, the bump heights decrease over time until they reach an unacceptable level.

In these processes, the leveler byproduct may be produced at a rate that is difficult to remove in an acceptable manner using traditional methods. For instance, many conventional substrates used in TSV electroplating have a via open area that is less than or equal to about 0.5% or 0.7% of the substrate, including 0.1 to 0.2% for some TSV memory applications (e.g., dynamic random access memory, i.e., DRAM), and 0.4 to 0.7% for some TSV logic applications. This is calculated by multiplying the area of a single via by the number of the vias on the wafer, and dividing this by the total area of the wafer. In general, the via density and byproduct generation scale in tandem such that increasing the via density correspondingly results in increased, in scale, byproduct generation. Pattern density is increasing in the semiconductor industry and for some high pattern density wafers, the via open area is greater than 0.5%, including close or equal to 1% and above 1% to about 2%. It has been found that these high pattern density wafers produce the leveler byproduct at a rate that, using conventional bleed and feed techniques, can only be removed with very high bleed and feed rate. These wafers also degrade the electroplating solution faster because the higher number of vias on a substrate, the more byproduct is produced. In some such processes, traditional bleed and feed techniques were used to remove the desired amount of leveler byproduct from the electroplating solution and this resulted in replacing 100% of the electroplating solution over 24 hours of electroplating. In comparison, an acceptable bleed and feed amount for most electroplating processes is the replacement of 10% to 20%, or less, of the solution over the same 24 electroplating hours.

The present inventors conceived of the systems and techniques discussed herein in order to control composition of the electroplating solution in a more economical fashion.

Definitions

The following terms are used intermittently throughout the instant disclosure:

"Substrate"—In this application, the terms "semiconductor wafer," "wafer," "substrate," "wafer substrate" and "partially fabricated integrated circuit" are used interchangeably. One of ordinary skill in the art would understand that the term "partially fabricated integrated circuit" can refer to a silicon wafer during any of many stages of integrated circuit fabrication thereon. A wafer or substrate used in the semiconductor device industry typically has a diameter of 200 mm, or 300 mm, or 450 mm. Further, the terms "electrolyte," "electroplating bath," "plating bath," "bath," "electroplating solution," and "plating solution" are used interchangeably. The work piece may be of various shapes, sizes, and materials. In addition to semiconductor wafers, other work pieces that may take advantage of the disclosed embodiments include various articles such as printed circuit boards, magnetic recording media, magnetic recording sensors, mirrors, optical elements, micro-mechanical devices and the like.

"Electroplating cell"—a cell, typically configured to house an anode and a cathode, positioned opposite to each other. Electroplating, which takes place on the cathode in an electroplating cell, refers to a process that uses electric current to reduce dissolved metal cations so that they form a thin coherent metal coating on an electrode. In certain embodiments, an electroplating system has two compartments, one for housing the is anode and the other for housing the cathode. In certain embodiments, an anode chamber and a cathode chamber are separated by a semi-permeable membrane that permits for the selective movement of concentrations of ionic species therethrough. The membrane may be an ion exchange membrane such as a cation exchange membrane. For some implementations, versions of Nafion™ (e.g., Nafion 324) are suitable for use as such a membrane.

"Anode chamber"—a chamber within the electroplating cell designed to house an anode. The anode chamber may contain a support for holding an anode and/or providing one or more electrical connections to the anode. The anode chamber may be separated from the cathode chamber by a semi-permeable membrane. The electrolyte held in the anode chamber is sometimes referred to as anolyte.

"Cathode chamber"—a chamber within the electroplating cell designed to house a cathode. Often in the context of this disclosure, the cathode is a substrate such as a wafer, e.g., a silicon wafer, having multiple partially fabricated semiconductor devices. The electrolyte held in the cathode chamber is sometimes referred to as catholyte. In many implementations, the cathode may be removable from the cathode chamber in order to allow a wafer to be connected with the cathode; the cathode may then be reintroduced into the cathode chamber and immersed in the catholyte. It will be understood that the anode chamber and the cathode chamber may also refer to different portions of the same overall structure, e.g., the electroplating cell. If a membrane is used, the membrane may serve as a partition between the two chambers.

"Electroplating solution" (or electroplating bath, plating electrolyte, bath, electroplating solution, solution, or primary electrolyte)—a liquid of dissociated metal ions, often in solution with a conductivity-enhancing solvent such as an acid or base. The dissolved cations and anions disperse uniformly through the solvent. Electrically, such a solution is neutral. If an electric potential is applied to such a solution, the cations of the solution are drawn to the electrode that has an abundance of electrons, while the anions are drawn to the electrode that has a deficit of electrons.

"Recirculation system"—a system that circulates the electroplating solution back into a central reservoir for subsequent re-use. A recirculation system may be configured to efficiently re-use electroplating solution and also to control and/or maintain concentration levels of metal ions within the solution as desired. A recirculation system may include pipes or other fluidic conduits together with a pump or other mechanism for driving recirculation.

"Froth" or "Frothing"—the act of deliberately producing relatively stable bubbles at an air-liquid interface as the result of agitation, aeration, ebullition, or chemical reaction. An apparatus that is specifically configured to froth a liquid is referred to herein as a "frother".

"Foam"—a collection of bubbles formed on or in a liquid, which may be stabilized by organic compounds and surfactants, and which may be typically formed by frothing.

First Example Electroplating System for Forming a Foam

Described herein are apparatuses and techniques for removing unwanted components, such as byproducts, from an electroplating solution by frothing the electroplating solution to form a foam to trap the unwanted component, and then removing this foam to remove the unwanted component from the electroplating solution.

Contrary to conventional electroplating processing, the present inventors discovered here that frothing the electroplating solution containing the unwanted byproduct to generate a foam was advantageous because the foam trapped the byproduct. This concept was confirmed in testing, at least in part, because when the foam was allowed to relax, i.e., transform back into a liquid form, the amount of leveler in the solution increased, indicating that the foam contained a much higher ratio of byproduct to electroplating solution than was present in the liquid electroplating solution/byproduct mixture. The present inventors thus realized that an electroplating system that included equipment configured to deliberately (and controllably) generate foam from the electroplating solution and then separate that foam from the electroplating solution would advantageously act to preferentially remove the unwanted excess byproduct from the electroplating system, thereby reducing the concentration of the unwanted byproduct and also reducing the "bleed and feed" feed rate.

The generation of the foam may be achieved through the use of a frother. As described herein, a frother is used for frothing the electroplating solution to generate the foam. The frother may have numerous configurations and may be positioned within the electroplating system in various ways. Examples of frothers are discussed farther below, but is to provide context for the positioning, configurations, and arrangements of the frother, a first example electroplating system and fluid flow within this system will first be discussed.

FIG. 1 depicts a first example electroplating system 100 having an electroplating cell 102, a reservoir 104 for containing electroplating solution, a plating cell flow loop 106, and an optional recirculation loop 108 for the reservoir 104. The cell 102 contains electroplating solution during at least the electroplating process, the reservoir 104 contains the electroplating solution, the plating cell flow loop 106 is configured to flow the electroplating solution between the cell 102 and the reservoir 104, and the recirculation loop 108, which is optional in some embodiments, is configured to recirculate, using a first pump 110, the electroplating solution within the reservoir 104.

Figure 2:
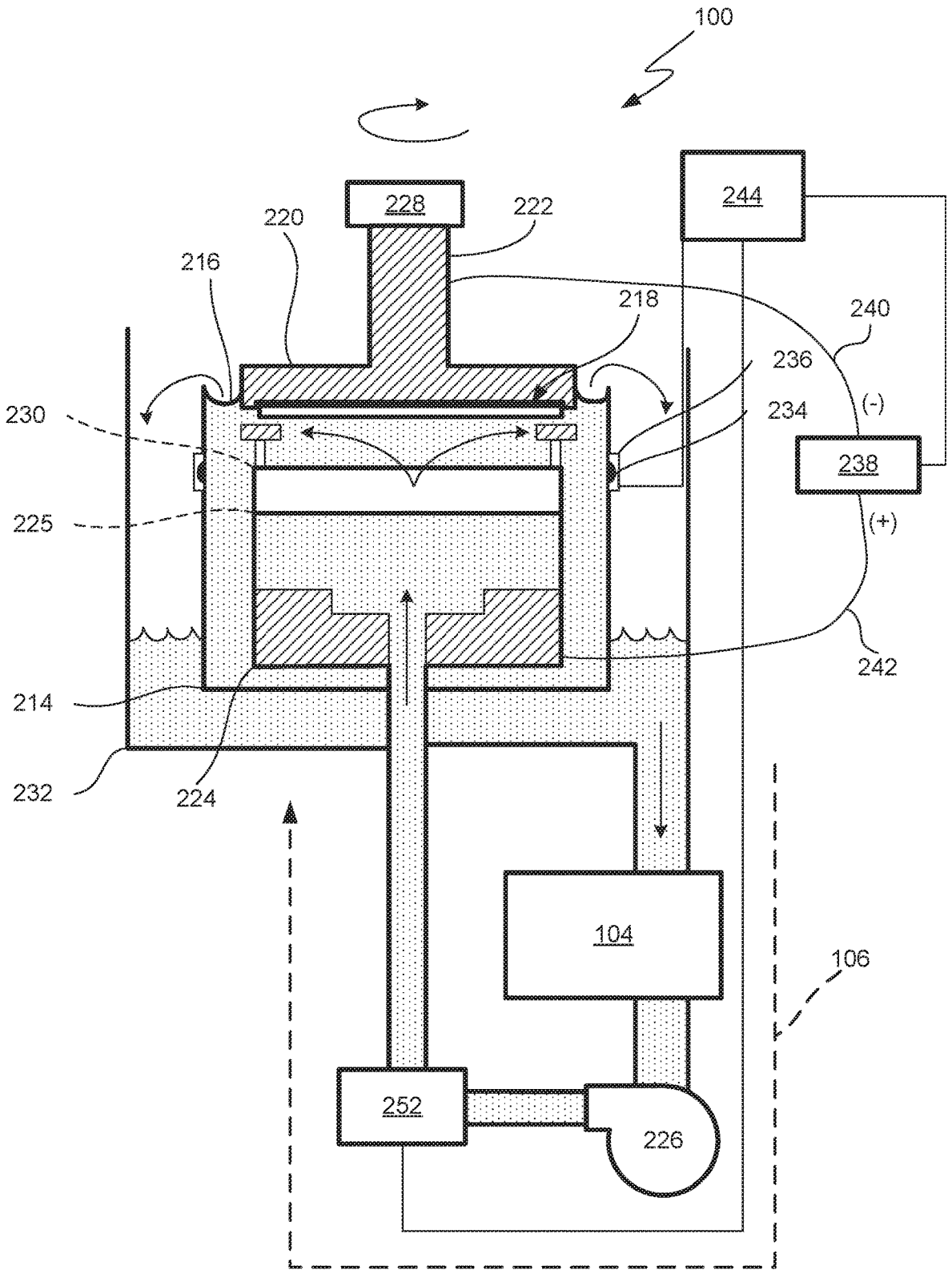
FIG. 2 depicts the first example system of FIG. 1 with a diagrammatical cross-sectional view of an electroplating cell.

FIG. 2 depicts the first example system of FIG. 1 with a diagrammatical cross-sectional view of an electroplating cell. Often, an electroplating system includes one or more electroplating cells in which the wafers are processed. Only one electroplating cell is shown in FIG. 2 to preserve clarity. In FIG. 2, a plating bath 214 contains the electroplating solution (having, for example, a composition as provided herein), which is shown at a level 216. The catholyte portion of this vessel is adapted for receiving substrates in a catholyte. A wafer 218 is immersed into the electroplating solution and is held by, e.g., a "clamshell" substrate holder 220, mounted on a rotatable spindle 222, which allows rotation of clamshell substrate holder 220 together with the wafer 218.

An anode 224 is disposed below the wafer within the plating bath 214 and is separated from the wafer region by a membrane 225, preferably an ion selective membrane. For example, Nafion™ cationic exchange membrane (CEM) may be used. The region below the anodic membrane is often referred to as an "anode chamber." The ion-selective anode membrane 225 allows ionic communication between the anodic and cathodic regions of the plating cell, while preventing the particles generated at the anode from entering the proximity of the wafer and contaminating it. The anode membrane is also useful in redistributing current flow during the plating process and thereby improving the plating uniformity. Ion exchange membranes, such as cationic exchange membranes, are especially suitable for these applications. These membranes are typically made of ionomeric materials, such as perfluorinated co-polymers containing sulfonic groups (e.g. Nafion™), sulfonated polyimides, and other materials known to those of skill in the art to be is suitable for cation exchange. Selected examples of suitable Nafion™ membranes include N324 and N424 membranes available from Dupont de Nemours Co.

During plating, the ions from the electroplating solution are deposited on the substrate. The metal ions must diffuse through the diffusion boundary layer and into the via hole or other feature of the wafer. A typical way to assist the diffusion is through convection flow of the electroplating solution provided by a second pump 226. Additionally, a vibration agitation or sonic agitation member may be used as well as wafer rotation which may be advantageous for uniform plating. For example, a vibration transducer 228 may be attached to the clamshell substrate holder 220.

During electroplating, the electroplating solution is continuously provided to the cell from the reservoir, and to the reservoir from the cell, by the plating cell flow loop which may operate as described herein, in some embodiments. As illustrated in the example embodiment in FIG. 2, the electroplating solution flows, using the second pump 226, from the reservoir 104 to the cell, enters the cell above the membrane on the cathode side and then flows upwards to the center of wafer 218, and then flows radially outward and across wafer 218. The electroplating solution then overflows plating bath 214 to an overflow reservoir 232. The electroplating solution is then flowed back to the reservoir 104, thereby completing the recirculation of the electroplating solution through the plating cell flow loop 106, which is partially indicated by dashed arrow 106.

Other features of the electroplating system 100 in FIG. 2 include a reference electrode 234 located on the outside of the plating bath 214 in a separate chamber 236, this chamber is replenished by overflow from the main plating bath 214. Alternatively, in some embodiments the reference electrode is positioned as close to the substrate surface as possible, and the reference electrode chamber is connected via a capillary tube or by another method, to the side of the wafer substrate or directly under the wafer substrate. In some of the preferred embodiments, the apparatus further includes contact sense leads that connect to the wafer periphery and which are configured to sense the potential of the metal seed layer at the periphery of the wafer but do not carry any current to the wafer. A reference electrode 234 is typically employed when electroplating at a controlled potential is desired. The reference electrode 234 may be one of a variety of commonly used types such as mercury/mercury sulfate, silver chloride, saturated calomel, is or copper metal. A contact sense lead in direct contact with the wafer 218 may be used in some embodiments, in addition to the reference electrode, for more accurate potential measurement (not shown).

A DC power supply 238 can be used to control current flow to the wafer 218. The power supply 238 has a negative output lead 240 electrically connected to wafer 218 through one or more slip rings, brushes and contacts (not shown); alternatively, the negative output lead may be electrically connected with the substrate holder 220, which may, in turn, be connected with the substrate. The positive output lead 242 of power supply 238 is electrically connected to an anode 224 located in plating bath 214. The power supply 238, a reference electrode 234, and a contact sense lead (not shown) can be connected to a system controller 244, which allows, among other functions, modulation of current and potential provided to the elements of electroplating cell. For example, the controller may allow electroplating in potential-controlled and current-controlled regimes. The controller may include program instructions specifying current and voltage levels that need to be applied to various elements of the plating cell, as well as times at which these levels need to be changed. When forward current is applied, the power supply 238 biases the wafer 218 to have a negative potential relative to anode 224. This causes an electrical current to flow from anode 224 to the wafer 218, and an electrochemical reduction (e.g. $Cu^{2+}+2e^{-}=Cu^{0}$) occurs on the wafer surface (the cathode), which results in the deposition of the electrically conductive layer (e.g. copper) on the surfaces of the wafer.

The system may also include a heater 252 for maintaining the temperature of the electroplating solution at a specific level. The electroplating solution may be used to transfer the heat to the other elements of the plating bath. For example, when a wafer 218 is loaded into the plating bath, the heater 252 and the second pump 226 may be turned on to circulate the electroplating solution through the electroplating system 200 until the temperature throughout the apparatus becomes substantially uniform. In one embodiment the heater is connected to the system controller 244. The system controller 244 may be connected to a thermocouple to receive feedback of the electroplating solution temperature within the electroplating apparatus and determine the need for additional heating.

Referring back to FIG. 1, the recirculation loop 108 may be used for various reasons. It may be advantageous to recirculate the electroplating solution contained within the reservoir 104 in order to mix the solution and prevent stagnation in the reservoir. In some embodiments, a diluent, a make up solution (e.g., a part of the "feed" of new electroplating solution), and organic additives may also be added directly to the reservoir from different sources and the recirculation loop 108 can mix the solution. In FIG. 1, the diluent, the make up solution, and the organic additives can be added directly to the reservoir 104 from sources 131, 139, and 157, respectively, via lines 159, 161, and 163, respectfully. Valves 171, 173, and 175 control the dosing of the diluent, the make-up solution, and the additives, respectfully. As discussed herein, these items may be used during the bleed and feed of the electroplating solution. In some instances, although not shown in FIG. 1, the recirculation loop 108 may include a filter for filtering the electroplating solution in the reservoir 104. Similar to above, the recirculation loop 108 may also include a heater or cooling unit configured to heat or cool the electroplating solution in the reservoir 104.

Positioning of a Frother within the First Example Electroplating System

In various embodiments, the frother is positioned in fluidic communication with one or more elements of the electroplating system such that when plating fluid is in the system, the frother can froth at least some of the plating fluid in order to generate the foam. In some embodiments, the frother may be a separate unit of the system such that it is not a part of the other system elements. For instance, as seen in FIG. 1, the frother 160 is a separate unit that is in fluidic connection with both the reservoir 104 and the recirculation loop 108; this frother is not a part of the other system elements. In some other embodiments, the frother may be a part of one or more elements in the system, such as positioned within the reservoir and configured to froth electroplating solution contained by the reservoir.

As seen more specifically in FIG. 1, the frother 160 is fluidically connected to both the reservoir 104 and the recirculation loop 108 with a frother flowpath 162 (labeled with 162 and shown with dotted lines). The frother flowpath 162 is configured to allow fluid to flow between the frother 160 and the reservoir 104, and the recirculation loop 108 and the frother 160. The direction of flow between these elements may be in either direction, and may be unidirectional or multi-directional. For example, representing the frother flowpath 162 as directional arrows indicates that electroplating solution flows from is the recirculation loop 108 to the frother 160, and from the frother 160 to the reservoir 104.

In some implementations, the frother flowpath 162 may have one or more valves at at least one of the intersection, or termination, points with the other elements of the electroplating system. The frother flowpath 162 in FIG. 1 has a first valve 164A at one intersection point 166A (circled by a dashed ellipse) with the recirculation loop 108, and has a second valve 164B at or near a second intersection point 166A (circled by a dashed ellipse) with the reservoir 104. Each of these valves is configured to control flow between each of its connected sections. The first valve 164A is configured to control flow of electroplating solution between the frother flowpath 162 and the recirculation loop 108 such that the fluid may only flow to one of these loops at one time. If the first valve is in a divert position, then fluid may be diverted from the recirculation loop 108 to the frother flowpath 162. The second valve 164B is configured to limit and stop the flow of fluid between the reservoir 104 and the frother flowpath 162 such that, when fully closed, the second valve 164B prevents fluid from flowing between the reservoir 104 and the frother flowpath 162. These intersection points shown in FIG. 1 are intended to be illustrative and non-limiting examples. For instance, the intersection of the frother flowpath 162 and the recirculation loop 108 may be in a different position along the recirculation loop 108 and may use other connection means. The valve may be various types of valves, such as a ball valve, globe valve, butterfly valve, needle valve, plug valve, poppet valve, sluice valve, spool valve, and other control valve.

Examples of Frother Configurations

The frother may be configured in different ways to generate the foam. As stated above, the frother is configured to froth the electroplating solution by agitating, aerating, ebullating, or chemically reacting the electroplating solution at an air-liquid interface to produce bubbles in the electroplating solution and thus generate the foam. In some embodiments, the generation of the foam may be assisted by surfactants and other compounds in the electroplating solution. Once the foam is generated and floating on the surface of the solution, it may be removed from the system in various ways. As discussed below, the frother may be configured to froth electroplating solution held by a container or held by one of the other elements of the electroplating system, such as the reservoir or the cell.

In some embodiments, the frother may be an aerator, such as an aeration stone, that is made of a porous material and configured to receive a gas. The aeration stone does not need to be a mineral-based material, e.g., a stone, but can be any material that is porous, such as a ceramic or polymeric material. The aerator may allow the gas to pass therethrough and into the electroplating solution contacting the aerator, thereby introducing a large number of individual gas streams into the solution through the pores of the aerator, and producing a large number of small streams of bubbles. Flowing the gas through the aerator aerates, and in some instances also agitates, the electroplating solution, which produces the foam. In some embodiments, the porous material of the aerator may have holes sized between about 1 micron and about 1 millimeter. The aerator may be comprised of a material compatible with the electroplating chemistry, such as a high-density polyethylene (HDPE), a polypropylene (PP), and polytetrafluoroethylene (PTFE), although other suitable materials may be used as well. Compatible may mean that the electroplating chemistry and the aerator do not adversely react to each other, such as the aerator decomposing or releasing unwanted material into the electroplating solution, or the electroplating solution reacting in some way to the aerator. The porosity of the aerator may be about less than or equal to 1 millimeter, including between about 1 millimeter and about 1 micron, porous material. The gas flowed through the aerator may comprise only nitrogen, only molecular oxygen ($O_2$), only ozone ($O_3$), or a mixture of gases, such as molecular oxygen and nitrogen. Any suitable gas may be used; the above list is not intended to be limiting. Generally speaking, the gas selected may be selected to avoid undesirably affecting the performance of the solution.

In some embodiments, the frother may be provided by one or more jets that are configured to flow a gas like described above, such as nitrogen, molecular oxygen, ozone, or a combination of these gases, or a fluid, such as the electroplating solution itself, into the electroplating solution in order to aerate and/or agitate the electroplating solution to generate the foam. If a portion of the electroplating solution itself is jetted back into the electroplating solution, the jets may be positioned such that the jets encounter the surface of the solution, thereby allowing air or other gas above the surface to become entrained in the jet and introduced into the solution.

In some embodiments, the frother may be configured to physically agitate the electroplating solution. For example, the frother may include a propeller or an impeller that are configured to contact the electroplating solution while rotating near the surface of the solution and generate the foam through agitation.

As stated above, in some embodiments, the frother may be a part of a foam generating unit that is separate from, but fluidically connected to, other elements of the electroplating system. The foam generating unit may include the frother and a container configured to hold a volume of the electroplating solution. In these embodiments, the frother is configured to froth the electroplating solution held in the container by, for instance, agitating, aerating, ebullating, or chemically reacting the electroplating solution at an air-liquid interface to produce bubbles in the electroplating solution held by the container to generate the foam. In some embodiments, the frother may be positioned within the container and configured to contact the electroplating solution held by the container. For example, one or more aeration stones, propellers, or impellers may be positioned within the container to aerate and/or agitate the electroplating solution in the container. In some similar examples, the foam generating unit may include one or more flowpaths that include the frother, such as a flow path containing a propeller or impeller.

Figure 3B:
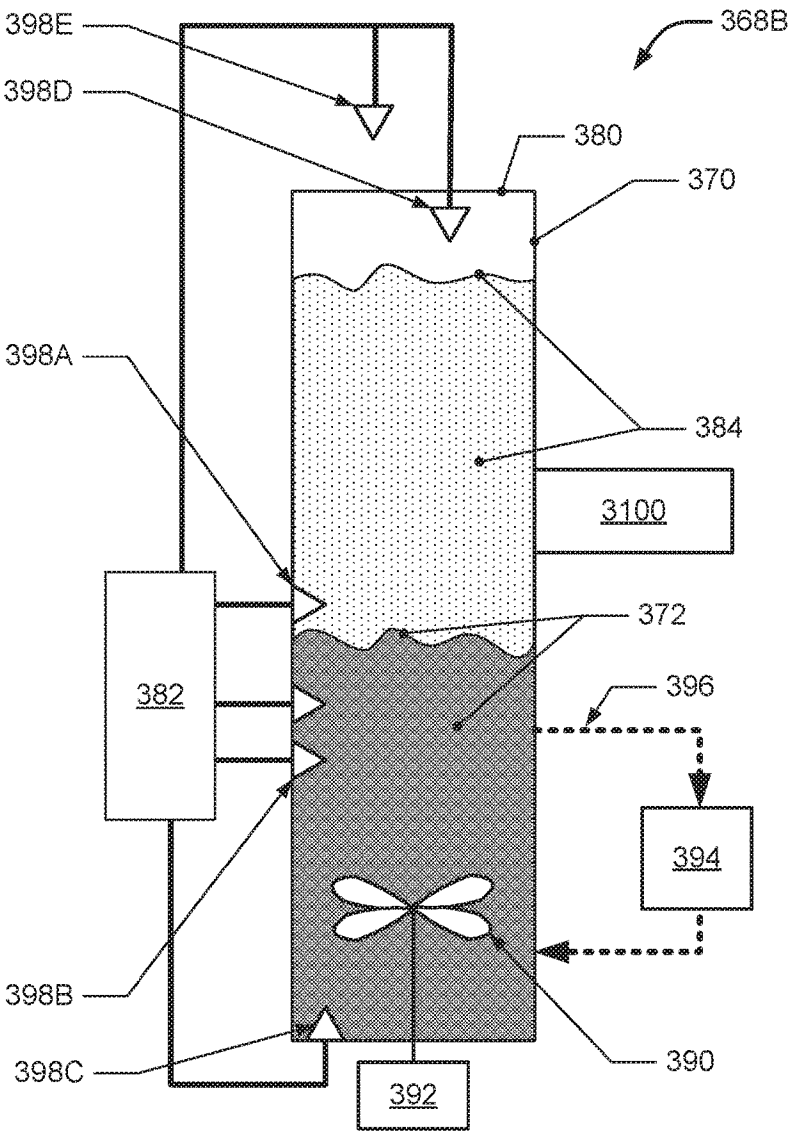
FIG. 3A depicts a first example foam generating unit and FIG. 3B depicts a second example foam generating unit.
Figure 3A:
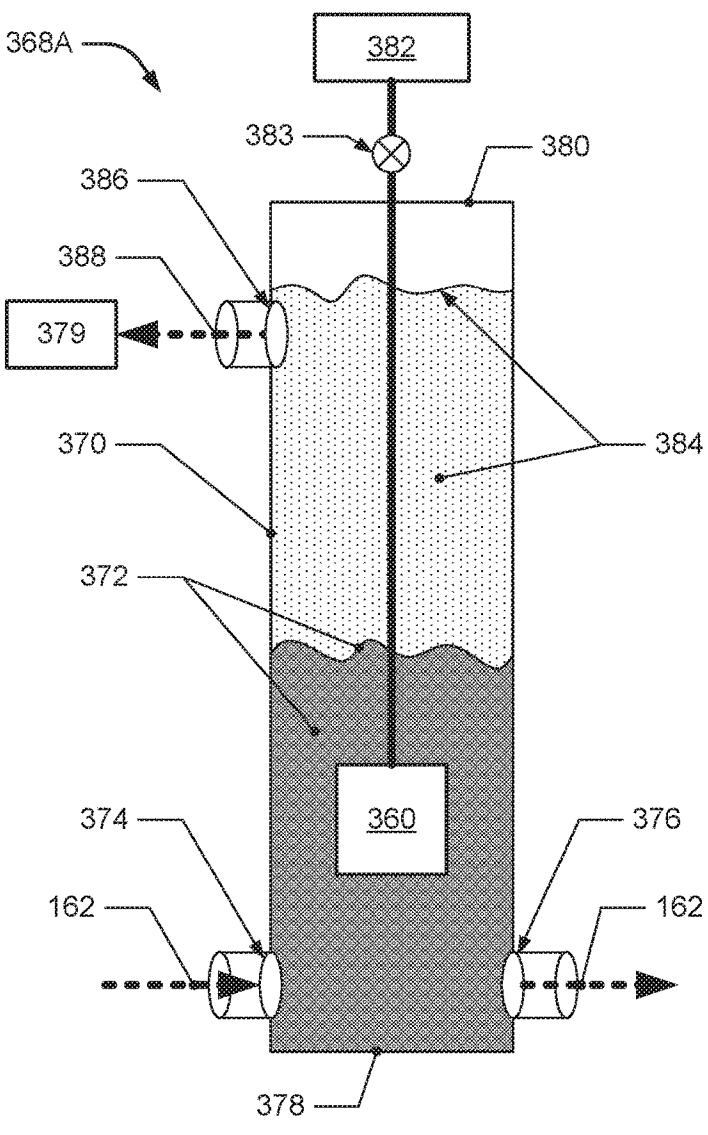

FIG. 3A depicts a first example foam generating unit 368A that includes a container 370 and the frother 160 positioned within the container 370. The container 370 is configured to hold a first volume of electroplating solution, represented by the dark shading and the top fluid level labeled 372. The container may include an inlet 374 and an outlet 376 through which the electroplating solution may enter and exit the container 370, respectively. Although the inlet 374 and outlet 376 are shown positioned near the bottom of the container 370, e.g., in a region immediately adjacent to the container bottom 378, the inlet 374 and the outlet 376 may be positioned at other locations of the container. For example, the inlet may be on the side of the container while the outlet may be in the bottom of the container; the inlet may be in the top (380) of the container; the inlet may be in a region immediately adjacent to the top 380 of the container; and container may have an open top which may serve as the inlet.

The container 370 is also fluidically connected to at least one other element of the electroplating system, such as the recirculation loop 108 and the reservoir 104, like depicted in FIG. 1, with the frother flowpath 162. Referring back to FIG. 1, the frother 160 labeled in this Figure may represent this and any other foam generating unit described herein. This representation includes any configuration described above between the frother 160 and the system 100, including the fluidic connections between the frother 160/foam generating unit 368A, the reservoir 104, and the recirculation loop 108.

In FIG. 3A, the frother 360 is positioned within the container and configured to aerate and/or agitate the electroplating solution in the container to generate the foam. The frother 360 of FIG. 3A is the aeration stone, described above, that is fluidically connected to a gas source 382 and configured to flow a gas from the gas source 382, such as nitrogen, oxygen, a mixture of these gases, another gas, or another mixture, into the container 370 so that the gas can aerate and/or agitate the electroplating solution in the container and generate the foam 384 (which is represented with light shading). In this embodiment, the electroplating solution 372 is illustrated interfaced with the frother 360 such that they are contacting each other; the frother 360 is also submerged in the electroplating solution 372. There may also be one or more valves 383 or other control elements, such as a mass flow controller, configured to control the flow of gas from the gas source 382 to the frother 360.

The container 370 may have a foam exit port 386 configured to allow the foam 384 in the container 370 to exit the container 370 through the foam exit port 386. In some embodiments, the foam exit port 386 may be connected to a drain 379 by a drain flowpath 388. Referring back to FIG. 1, drain 179 is also seen and represents the location where the foam may flow from the frother 160. Generally speaking, the exit port may be located above the surface of the first volume of electroplating solution. As the foam is generated and increases in volume, the foam may, in effect, force itself out of the exit port 386 and into the drain 179. Alternatively or additionally, a gas may be flowed into the top of the container 370 and out of the exit port 386, causing foam that is in the gas flow path to be actively drawn into the exit port 386 and into the drain 379.

The foam generating unit may be configured in numerous other ways, for example, as illustrated in FIG. 3B, which depicts a second example foam generating unit. The container 370 of the second example foam generating unit 368B is depicted along with the electroplating solution 372 and the foam 384. The inlet and outlet are not depicted for clarity but this container may have the same inlet and outlet described with respect to FIG. 3A. Numerous examples of different types of frothers and their positioning are illustrated in FIG. 3B; it is to be understood that these are illustrative, non-limiting examples, and that a foam generating unit may not include all of these frothers in one unit, but rather these multiple examples are provided in one Figure for clarity and conciseness. In some embodiments, the frother may be a propeller 390 connected to a motor 392 that is configured to agitate the electroplating solution 372 and generate the foam. The frother may also be an impeller 394 that is positioned outside the container 370 but fluidically connected to the container 370 by an impeller flow path 396 and configured to generate the foam 384; in some other embodiments, the impeller 394 may be positioned within the container similar to the propeller 390.

In some embodiments, the frother may be a plurality of nozzles, represented as triangles labeled 398A-E, that may be positioned within or outside the container at various locations. One or more nozzles may be positioned in the side of the container, such as nozzles 398A which may be above a fill line of the container 370, and nozzle 398B which may be below the fill line. One or more nozzles may also be in the bottom 378 or the bottom region of the container like nozzle 398C, inside the container 370 at the top 380 or a top region of the container as with nozzle 398D, or outside the container 370 but at the top 380 of the container 370 so that fluid or gas may flow into the container 370 through the top 380, as with nozzle 398E. In some such embodiments, the nozzles may be configured to flow a gas into the container 370 from a gas source 382, similar to the aerator stone, in order to aerate and/or agitate the electroplating solution in the container 370. For these nozzles that may contact the electroplating solution, the interface between these nozzles and the electroplating solution may be the interaction of flowing the gas or fluid into the electroplating solution.

In some embodiments, one or more of the nozzles may be configured to flow the electroplating solution itself into the container 370 which may aerate and/or agitate the electroplating solution and generate the foam. For these nozzles that may flow the electroplating solution out of the nozzles, the interface between these nozzles and the electroplating solution may be the act of flowing the electroplating solution. In some similar embodiments, the nozzles may be configured to flow both the electroplating solution and a gas, simultaneously and/or consecutively, in order to generate the foam. For example, the nozzles may first flow the electroplating solution into the container to agitate and generate some foam and after this, the nozzles may then flow a gas into the container to further generate the foam. For these such nozzles, the interface between these nozzles and the electroplating solution may be both the act of flowing the gas or liquid into the electroplating solution, as well as the act of flowing the electroplating solution out of the nozzles.

As stated above, it is desirable to remove the foam from the electroplating system in order to remove the byproducts trapped in the foam. In some embodiments, like in FIG. 3A, the container is configured such that the foam can exit out of the container in a relatively unaided manner. Here, the foam generation causes the foam 384 to form and rise inside the container 370 and then flow out of the container 370 through the foam exit port 386 with the assistance of gravity and the pressure of the generated foam 384 in the container 370. In some other embodiments, the foam generating unit may have elements configured to move the foam, such as a foam movement unit configured to move, remove, or assist in the removal of, the foam from the electroplating system. This may include a first element configured to extract the foam, such as a vacuum unit, or a second element configured to cause the foam to move to the foam exit port, such as a skimmer, a fan, or a blower. A skimmer may be considered a device designed to remove items on a liquid surface, such as foam; a skimmer may be a weir skimmer that allows the foam floating on the surface of the solution to flow over a weir; a belt skimmer which uses a belt, operating on a motor and pulley system, runs through the electroplating solution containing the foam to pick up foam from the surface and after traveling over the head pulley, the belt passes through tandem wiper blades where foam and electroplating solution is scraped off both sides of the belt and discharged; and a mechanical arm or pusher that pushes the foam. Referring to FIG. 3B, this foam movement unit is represented as item 3100.

Instead of being a separate unit, in some embodiments the frother may be configured to interface with and froth electroplating solution contained within the fluid-holding elements of the electroplating system, such as the cell and/or the reservoir. The reservoir and/or the electroplating solution-holding bodies of the cell may be configured in a similar manner to the container of the foam generating unit described above and shown in FIGS. 3A and 3B. For example, any of the frothers described above may be positioned and configured to froth the electroplating solution held in the plating bath 214 or the overflow reservoir 232 as described above with respect to the containers 370 of FIGS. 3A and 3B. In some instances, as shown in FIG. 3A, an aerating stone may be positioned within the reservoir, the plating bath 214, or the overflow reservoir 232 of the cell in order to aerate and agitate the electroplating solution and generate a foam in these bodies. Similarly, any of the frothers shown in FIG. 3B, like a propeller, an impeller, or nozzles may be positioned within and around the reservoir 104, the plating bath 214, or the overflow reservoir 232 to froth the electroplating solution held in these bodies as discussed herein above. For instance, a propeller may be positioned within the reservoir in order to agitate and generate a foam inside the reservoir. Additionally, nozzles may be positioned on the sides, top, or above the reservoir 104, plating bath 214, or the overflow reservoir 232 in order to flow a gas or electroplating solution into these fluid-holding bodies in order to generate the foam.

In order to remove the foam from these fluid-holding bodies, the electroplating system may be configured like described above in order to allow, move, or remove the foam from the system. In some embodiments, the fluid-holding bodies of the electroplating system, e.g., the reservoir, plating bath, and overflow reservoir, may have a foam exit port like described above and shown in FIG. 3A which allows the foam to flow out of the fluid-holding body. The fluid-holding bodies of the electroplating system may also have a foam movement unit, like described above, that is configured to move, remove, or assist in the removal of, the foam from the electroplating system which may include the first element configured to extract the foam (e.g., a vacuum unit), or the second element configured to cause the foam to move to the foam exit port, such as a skimmer, a fan, or a blower.

In some embodiments, the container may be configured to hold at least 1 liter of electroplating solution. It has been found that, in some such implementations, for an electroplating system that contains a total amount of plating fluid of about 100 L, that periodically frothing about 1 L of the electroplating solution for a particular time interval can remove a desired amount of byproducts.

Figure 4A:
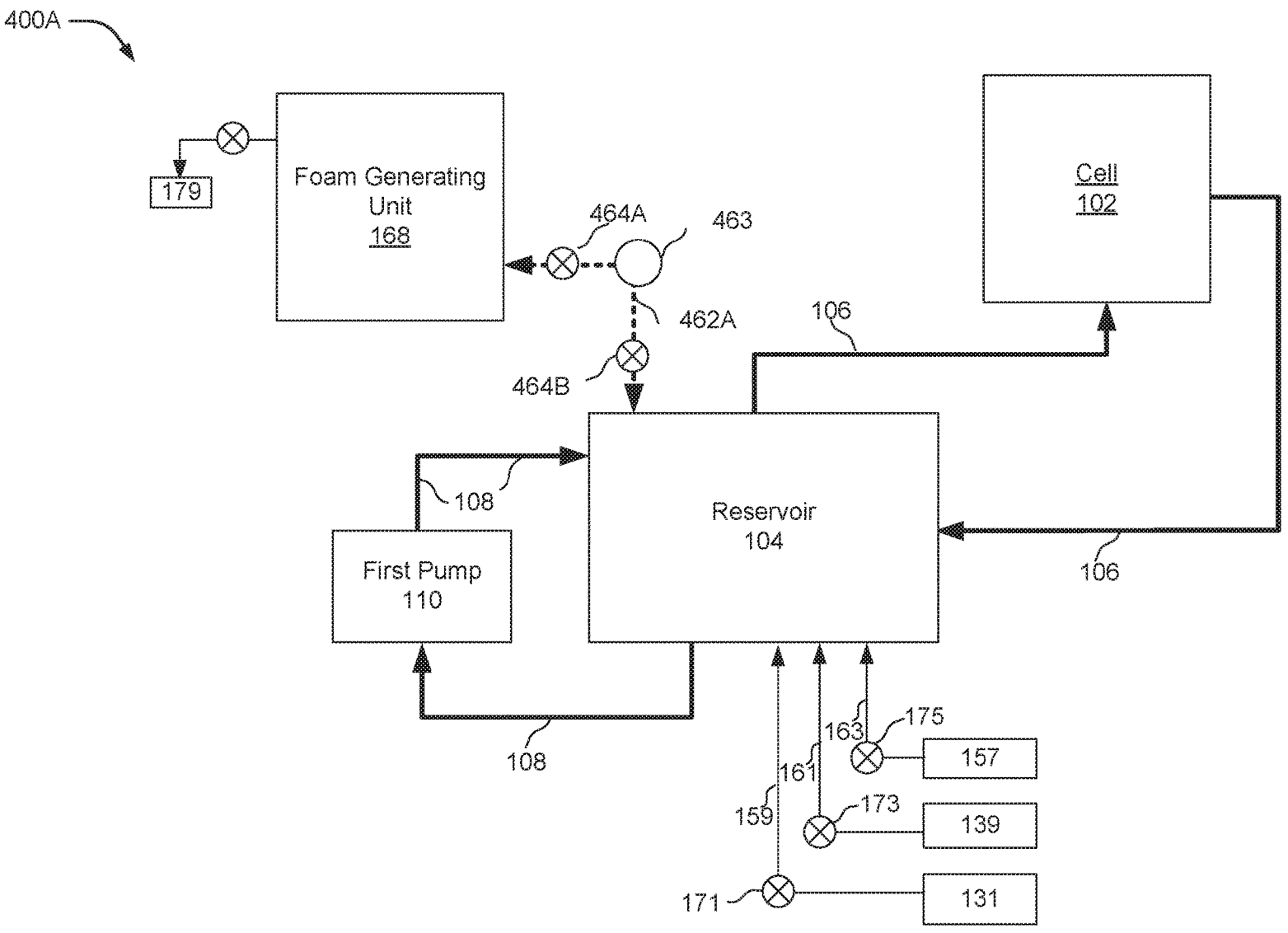
FIGS. 4A through 4E depict various example configurations of electroplating systems with separate foam generating units.

Example Configurations of a Separate Foam Generating Unit Positioned within Electroplating Systems As stated above, the frother may be a separate foam generating unit that is fluidically connected to other elements of the electroplating system. Each of the fluidic connections between the foam generating unit and/or frother to another element of the electroplating solution may be considered a fluid flowpath or conduit which allows fluid to travel between these elements. In some instances, this may be considered a loop. FIGS. 4A through 4E depict various example configurations of electroplating systems with separate foam generating units. In FIG. 4A, electroplating system 400A is configured such that the foam generating unit 168, which contains the frother (not shown), is fluidically connected directly to only the reservoir 104 such that electroplating solution flows between these elements through the same frother flowpath 462A. This flowpath may not be a loop in some instances, as shown in FIG. 4A, while in other instances this flowpath may be a loop between just these two elements, i.e., the foam generating unit 168 and the reservoir 104. In the depicted example, electroplating solution may be moved from the reservoir 104 to the foam generating unit 168 by the same fluid flow path that is used to move the electroplating solution from the foam generating unit 168 to the reservoir 104. Other implementations may have separate supply/return flow paths to/from the foam generating unit, thereby allowing for continuous circulation of the electroplating solution through the foam generating unit. One or more valves, such as the two valves 164A and 164B, may control the flow of electroplating solution through this flowpath 462A.

Figure 4B:
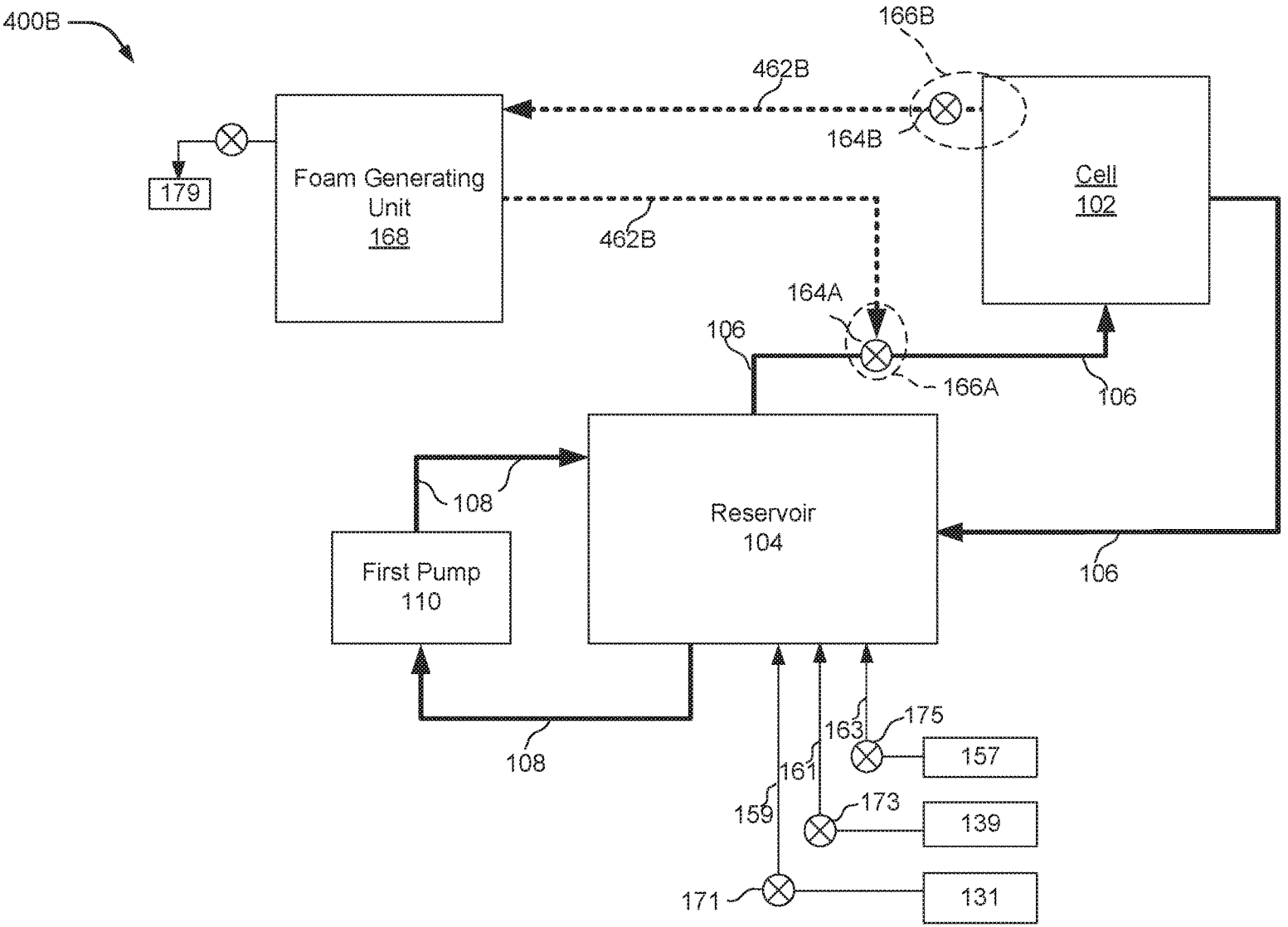

In FIG. 4B, electroplating system 400B is configured such that the foam generating unit is fluidically connected to the plating cell flow loop 106 and the cell 102 with the frother flowpath 462B. This system may include one or more valves that are configured to control the flow of electroplating solution within this frother flowpath 462B and between the foam generating unit 168, the plating cell flow loop 106, and the cell 102. For instance, similar to FIG. 1, system 400B includes a first valve 164A at the intersection 166A of the frother flowpath 462B and the plating cell flow loop 106 that is configured to control the flow of electroplating solution between these two elements, which in turn controls the flow between the foam generating unit 168 and the plating cell flow loop 106. The system 400B also includes a second valve 164B at the intersection 166B between the cell 102 and the frother flowpath 462B configured to control the flow between these two elements, which in turn controls the flow between the cell 102 and the foam generating unit 168. The system 400B may be configured such that fluid may flow in one or both directions through the frother flowpath 462B, such as in the directions indicated by the arrows of the frother flowpath 462B, the opposite direction, and in either direction.

Figure 4C:
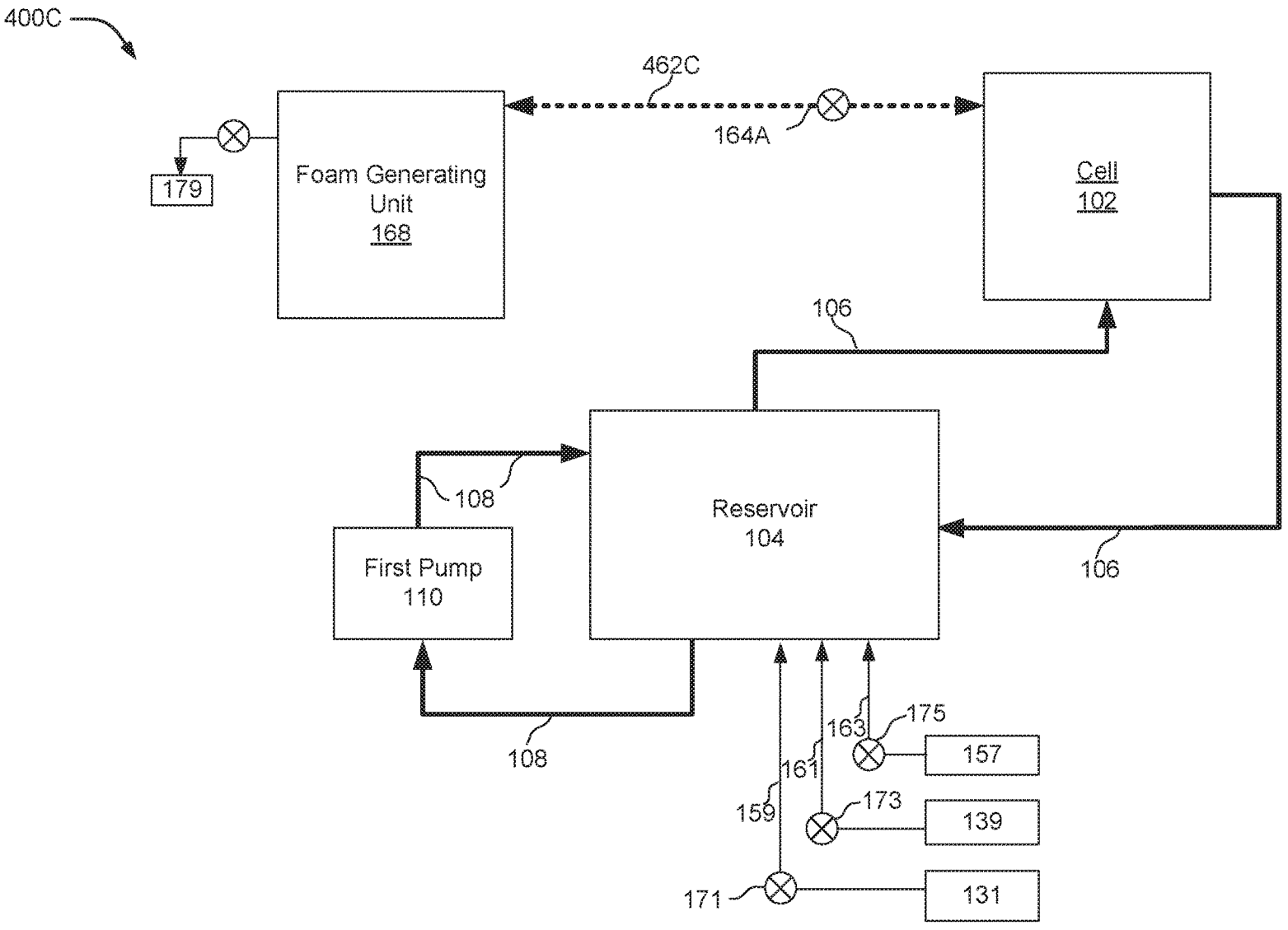

In FIG. 4C, electroplating system 400C is configured such that the foam generating unit 168 is fluidically connected directly to only the cell 102 with the frother flowpath 462C. Similar to FIG. 4A, the system 400C includes one or more first valves 164A configured to control the flow of electroplating solution between these two elements, i.e., the foam generating unit 168 and the cell 102. In some instances, this flowpath 462C is not a loop while in other instances, this flowpath may be a loop between just these two elements.

Figure 4D:
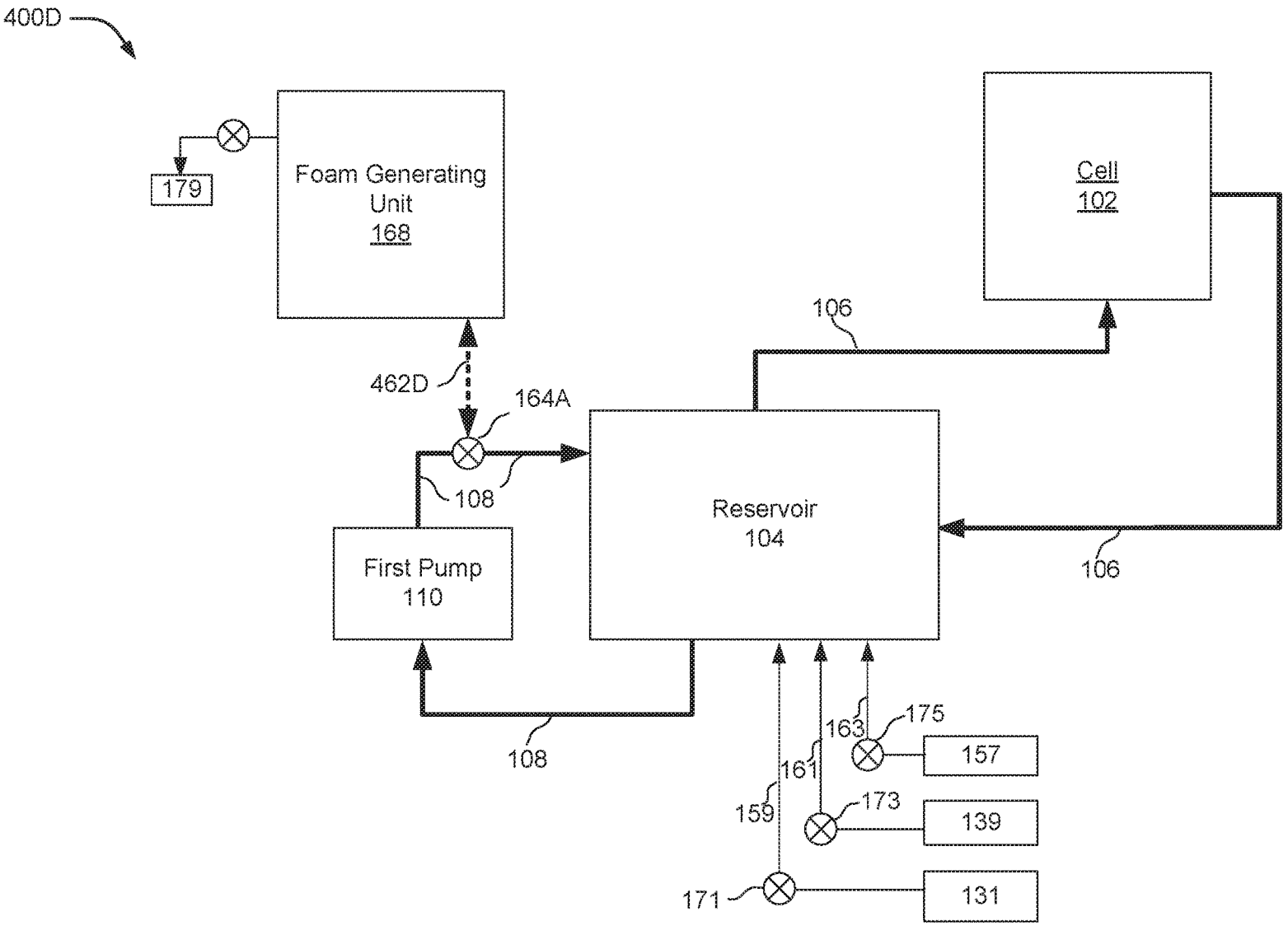

In FIG. 4D, electroplating system 400D is configured such that the foam generating unit 168 is fluidically connected directly to only the recirculation loop 108 with the frother flowpath 462D. Similar to FIGS. 4A and 4B, the system 400D includes one or more first valves 164A configured to control the flow of electroplating solution between these two elements, i.e., the foam generating unit 168 and the recirculation loop 108. In some instances, this flowpath 462D is not a loop while in other instances, this flowpath may be a loop between just these two elements.

Figure 4E:
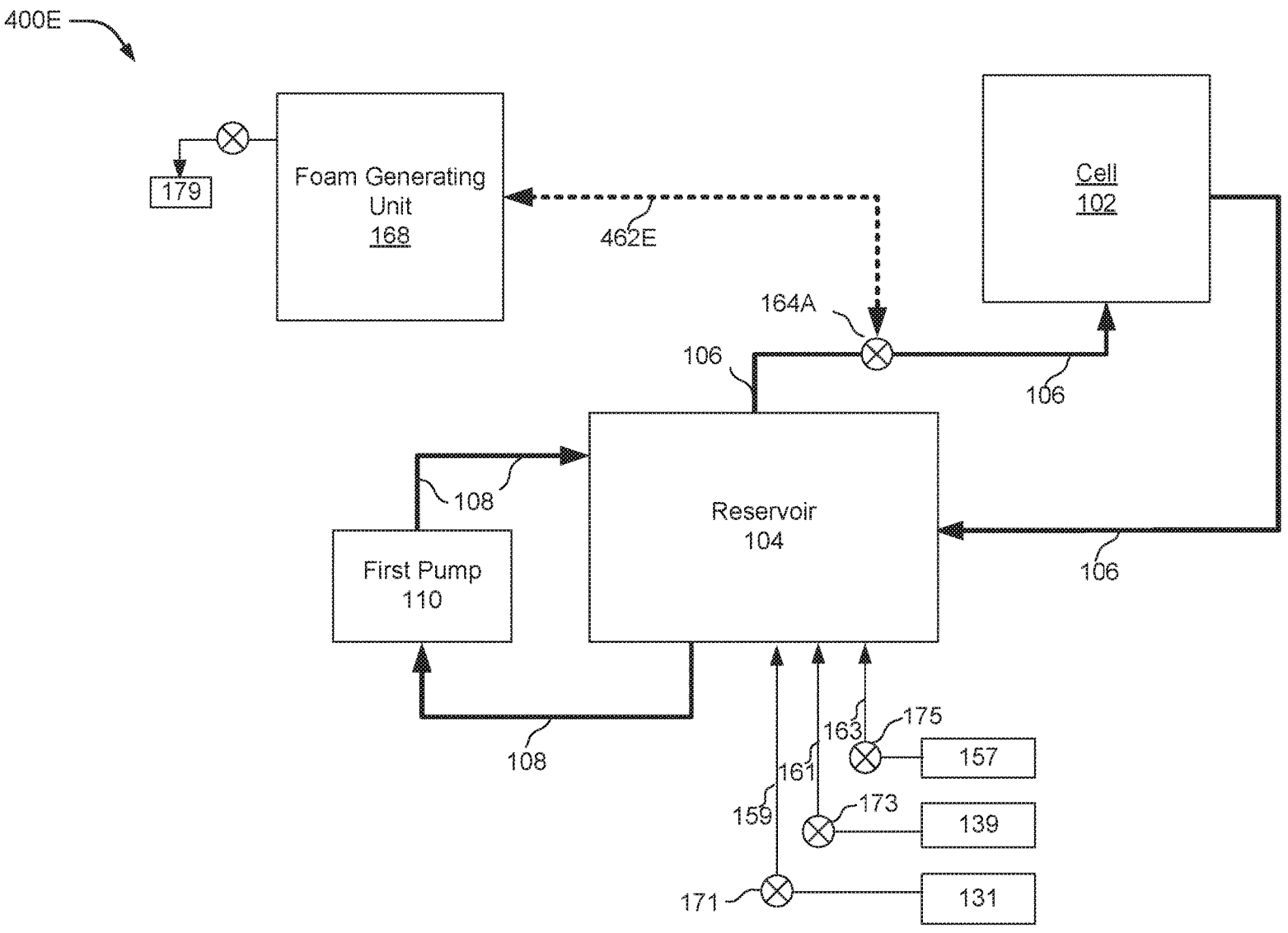

In FIG. 4E, electroplating system 400E is configured such that the foam generating unit 168 is fluidically connected directly to only the plating cell flow loop 106 with the frother flowpath 462E. Similar to FIGS. 4A, 4B, and 4D, the system 400E includes one or more first valves 164A configured to control the flow of electroplating solution between these two elements, i.e., the foam generating unit 168 and the plating cell flow loop 106. In some instances, this flowpath 462E is not a loop while in other instances, this flowpath may be a loop between just these two elements.

In all of these example systems, one or more pumps may be used to cause electroplating solution to move to and from the frother and foam generating unit. For example, in FIG. 4A, a pump 463 is positioned within the frother flowpath 462A and is configured to pump the electroplating solution from the reservoir 104 to the foam generating unit 168, and from the foam generating unit 168 to the reservoir 104. This pump may be positioned in any and all of the other electroplating systems described herein, including FIGS. 4A through 4E, as well as FIGS. 1 and 2.

Although not depicted in these Figures, the foam generating unit may also have direct fluidic connections to multiple elements in the system, such as the reservoir and the cell, and also direct fluidic connections to all of the elements in the electroplating system.

Example Techniques for Frothing Electroplating Solution

Figure 5:
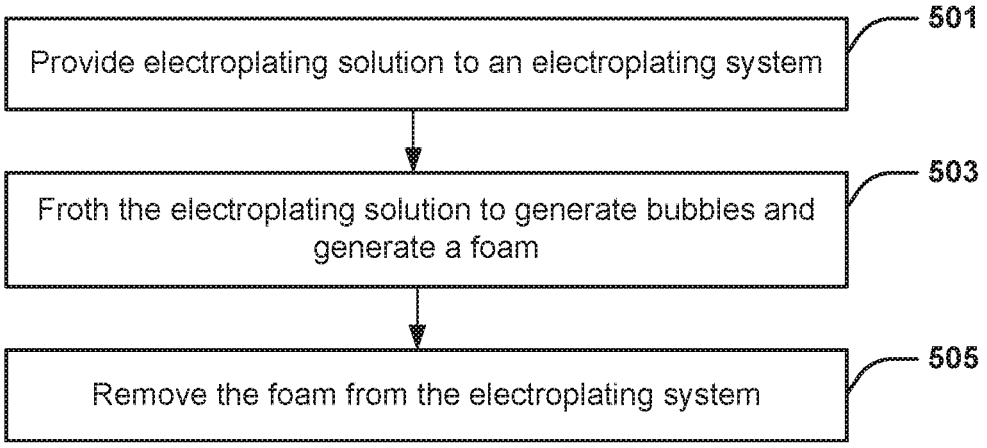
FIG. 5 depicts a first example technique for frothing electroplating solution.

Various techniques may be used to froth electroplating solution. FIG. 5 depicts a first example technique for frothing electroplating solution. In block 501, an electroplating solution is provided to an electroplating system which may be any of the systems described herein. In block 503, the electroplating solution is in the electroplating system, a frother may froth the electroplating solution, e.g., agitate, aerate, and/or ebbulate, the electroplating solution to generate bubbles which in turn generate the foam. This frothing may be caused by any of the frothers described above that froth the electroplating solution held in the container of the foam generating unit, or held in other elements of the electroplating system, such as the reservoir and cell. In some embodiments, the frothing may include flowing a gas, which may include nitrogen, into the aeration stone when the frother is interfaced with the electroplating solution.

As stated above, the frother is interfaced with the electroplating solution during the frothing. In some implementations, this interfacing may include causing the electroplating solution to surround and contact at least a part of the frother. For the container of the foam generating unit, this may further include flowing the electroplating solution into the container so that the electroplating solution is contacting and/or surrounding the frother. In some other embodiments, this interfacing may include causing the frother to interface with the electroplating solution by causing nozzles which are not physically contacting the electroplating solution (e.g., nozzles 398D and 398E in FIG. 3B) to flow a gas onto and into the electroplating solution, or cause the nozzles to flow the electroplating solution into a fluid-holding body like the container.

In block 505, the foam may be removed from the system. Like described above, this removal may be an unaided removal in which the pressure of the generated foam and gravity causes the foam to flow out of the container, the reservoir, or the cell. This removal may also include the foam flowing to the drain through the drain flowpath. As stated above, the frothing of this solution generates a foam which traps the byproduct in the foam and the removal of this foam from the system removes the unwanted byproducts, e.g., the levelers, from the electroplating system.

Figure 6:
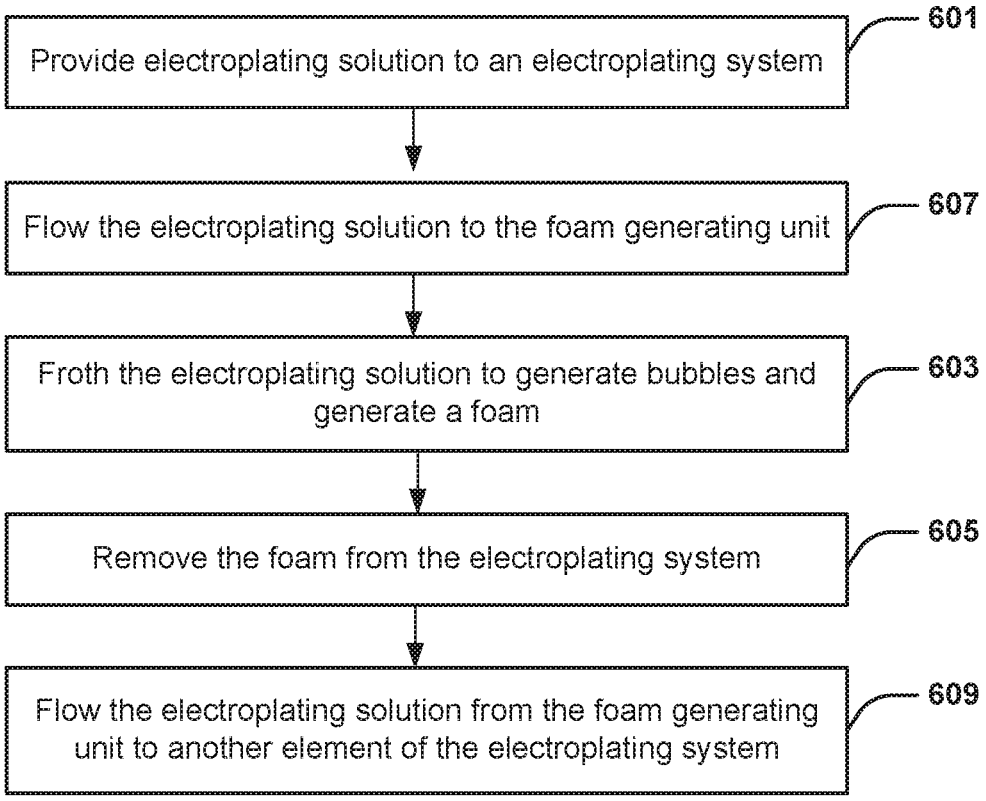
FIG. 6 depicts a second example technique for frothing electroplating solution.

In some embodiments which include the foam generating unit, the techniques described herein may also include operations of flowing the electroplating solution to and from the foam generating unit. FIG. 6 depicts a second example technique for frothing electroplating solution. Here, blocks 601, 603, and 605 are the same as blocks 501, 503, and 505, respectively, of FIG. 5. As can be seen, after block 601 and before block 603, block 607 is performed which includes flowing the electroplating solution to the foam generating unit; this may include operating one or move valves and/or a pump to cause and allow the electroplating solution to flow to the unit. For example, referring to FIG. 4B, this operation block 607 may include opening valve 164B which allows fluid to flow from the cell 102 to the frother flowpath 462B and to the foam generating unit 168.

In some embodiments, the frothing of block 603 may further include holding the electroplating solution, such as the first volume (e.g., 1 liter) in the container during the frothing. After this frothing of block 503 and removal of the foam, the electroplating solution may be flowed back into another element of the electroplating system which again may include operating a valve and/or pump, as represented by block 609. For instance, still referring to FIG. 4B, this may include operating valve 164A so that the electroplating solution may flow from the foam generating unit 168 through the frother flowpath 462B and to the plating cell flow loop 106.

Figure 7:
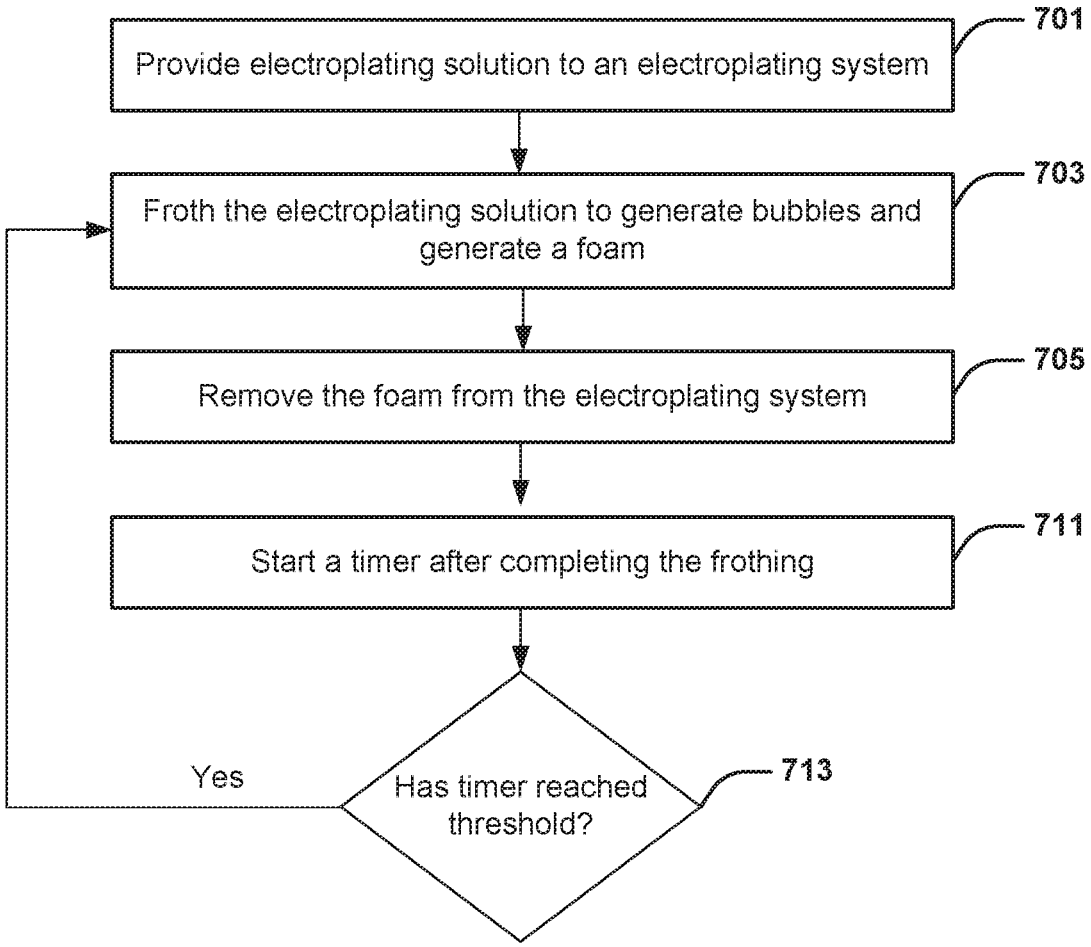
FIG. 7 depicts a third technique for frothing electroplating solution similar to that of FIG. 5.

The occurrence of frothing the electroplating solution may be based on periodic, time-based intervals, as well as detected and determined conditions of the electroplating system. In some embodiments, the electroplating solution may be frothed for a specific duration, such as a first time period, e.g., about 1 minute, between 1 to 10 minutes, and 30 minutes. The frothing may also be repeated on time-based intervals, including the same or different intervals during processing. FIG. 7 depicts a third technique for frothing electroplating solution similar to that of FIG. 5. Blocks 701, 703, and 705 are the same as blocks 501, 503, and 505, respectively, in FIG. 5. After the frothing of block 703 is performed, or after the foam is removed in block 705, block 711 may be performed to start a timer that tracks the next repetition of frothing. The timer is monitored and compared against a threshold time, which may be the periodic interval such as 30 minutes, and once the timer reaches the threshold, the frothing and foam removal of blocks 703 and 705 may be repeated. In some embodiments, the threshold time may be between about two minutes and about 30 minutes (+/−5%); this allows for an idle time between frothing of between about 2 minutes and 30 minutes, including 5 minutes. It has been discovered for some electroplating processes and solutions that beginning frothing between 2 minutes and 30 minutes after completing the frothing can reduce the unwanted by products at a high enough and frequent enough rate that the generated byproducts do not adversely affect electroplating processes. In some examples, the frothing may occur for about three minutes, followed by an idle of two minutes, followed by another frothing of about 3 minutes, followed by another idle of about two minutes, which may be repeated during the electroplating. It has also been found that for some electroplating processes, frothing 1 liter (L) of electroplating solution in an electroplating system that contains approximately 100 L of electroplating solution for between approximately 1 to 10 minutes can remove a desired amount of byproducts better than traditional bleed and feed techniques. For some electroplating systems that have 200 L of electroplating solution, frothing 2 L of electroplating solution, including using two containers that each contain about 1 L of electroplating solution, for approximately 1 to 10 minutes can remove a desired amount of byproducts better than traditional bleed and feed techniques. In some embodiments, the frother may be configured to froth about 1%, 2%, or 5% of the total volume of electroplating solution in the system.

In some embodiments, frothing the electroplating solution may occur based on a determination of a voltage change within the electroplating system. As described above with respect to FIG. 2, during electroplating of a wafer, the DC power supply 238 controls current flow to the wafer 218 and the other electrical components of the electroplating cell. The controller includes various program instructions for the current and voltage levels, as well as for monitoring and detecting the changes in voltage across the wafer and other system elements. A change in the voltage across the wafer may, in some instances, indicate when the vias on the wafer have become full, i.e., satisfactorily plated. Under normal electroplating circumstances when the byproducts in the electroplating solution are below a particular undesirable threshold, a voltage change of a certain amount at a particular time will occur to indicate that the vias in the wafer are full.

When the electroplating solution has degraded past a undesirable threshold, such as when the leveler byproducts are at or above the threshold, the voltage across the wafer may change earlier or later, more or less, or both, than expected under normal operations. For example, if there is too much byproduct in the electroplating solution (such that desirable electroplating does not occur, e.g., the bump height is less than a particular height), the voltage change may occur earlier than under normal electroplating conditions. The specific voltage signals may be dependent on the wafer type, TSV size, die layout, and is patter density. For some substrates, bath height degradation may occur when the voltage change is greater than about +/−10% of the voltage of the electroplating solution without any byproducts. The system controller is configured to detect this change, determine whether this change is above or below an expected change amount, determine whether this change has occurred earlier or later than expected, and based on one or both of these determinations, determine that the byproducts are above the threshold and cause frothing to occur. In some instances, the threshold amount may be lower than the actual level at which undesirable plating occurs; this may keep the electroplating solution at the desirable byproduct levels, and thus produce consistent and desirable electroplating on wafers, by preemptively frothing the electroplating solution and removing the byproducts before the electroplating solution reaches the undesirable amount.

Figure 8:
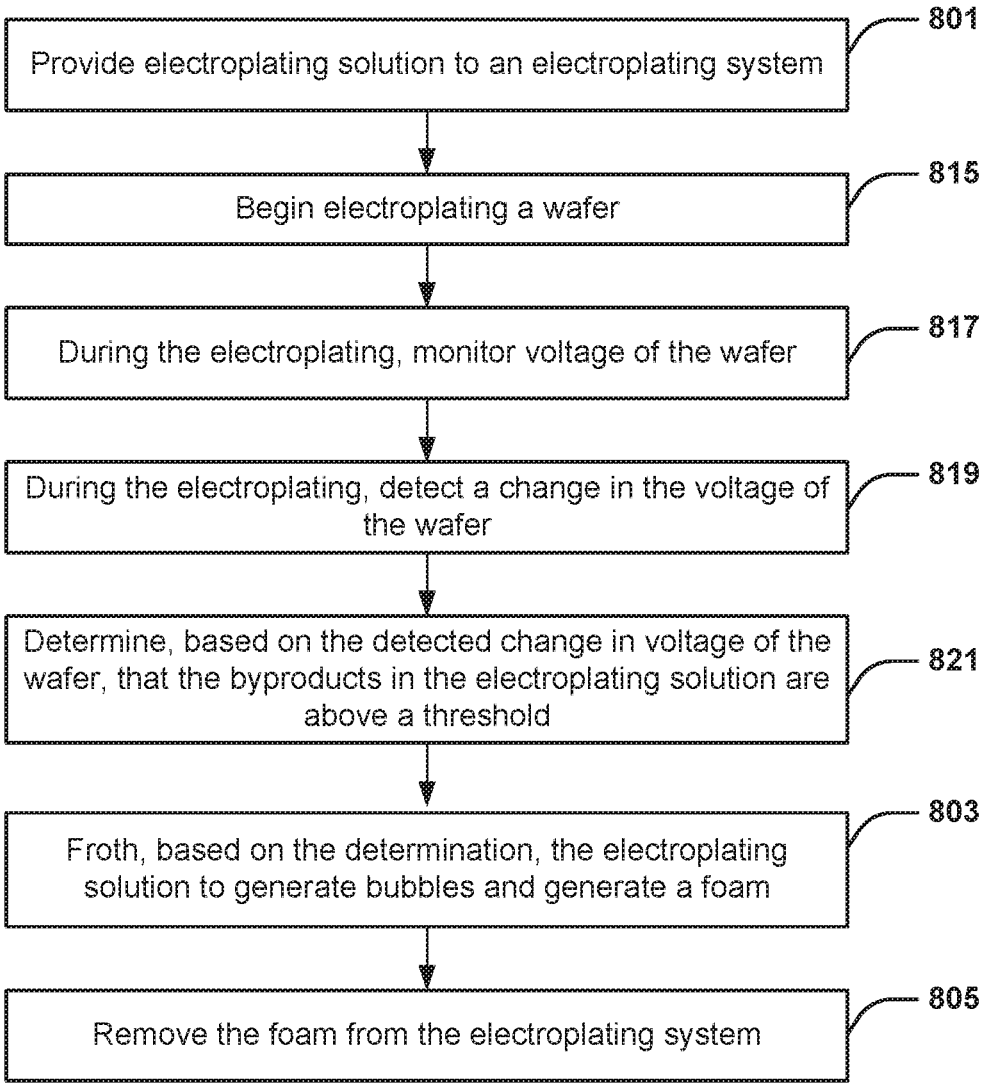
FIG. 8 depicts a fourth example technique for frothing electroplating solution.

FIG. 8 depicts a fourth example technique for frothing electroplating solution. Blocks 801, 803, and 805 are the same as blocks 501, 503, and 505, respectively, in FIG. 5. This example technique begins with block 801, followed by block 815 in which electroplating of a wafer begins; this electroplating is as described herein, including applying a voltage to a wafer and across the electroplating solution. During this electroplating, in block 817, the voltage applied to the wafer is monitored as described above, and in block 819, a change of the voltage may be detected and in block 821, a determination may be made, based on the detected voltage change, whether the byproducts in the system are above a threshold. As described above, this determination includes determining whether this change is above or below an expected change amount, whether this change has occurred earlier or later than expected, or both. If these changes are outside the normal, expected changes, then the byproducts in the electroplating solution may be above the desired amounts. Once the determination is made that the byproducts in the system are above a threshold, then the frothing of the electroplating system and removal of the foam of blocks 803 and 805 are performed.

In some embodiments, the electroplating solution may be continuously frothed during the electroplating, including during all of the desired electroplating of one and/or multiple substrates. In some of these embodiments, the electroplating fluid may be continuously flowed to, or interfaced with, the frother. This may include continuously flowing the electroplating solution into and out of the container while continuously operating the frother to froth the electroplating solution in the container. This may also include continuously removing the generated foam from the system. Referring to FIG. 5, for instance, during electroplating, blocks 503 and 505 may be continuously performed. Referring to FIG. 6, for another example, during electroplating blocks 607, 603, 605, and 609 may be continuously performed.

In some embodiments, the techniques described above may including both frothing the electroplating solution and performing bleed and feed operations to remove the byproducts and maintain the electroplating solution at the desirable levels. Any of the above techniques, such as those of FIGS. 5 through 8 may also include one or more operations of performing a bleed feed operation which may be a continuous or periodic operation during electroplating processing. The bleed and feed operations may also include a dilution operation to dilute the solution.

The above techniques and apparatuses are applicable to various electroplating processes. This includes wafers with high-density features like vias and trenches that may produce more byproduct levelers than traditional wafers. This may also include electroplating processes of wafers having a photoresist that may be released into the electroplating solution and may adversely affect the plating process. The foam generated by frothing the electroplating solution that contains photoresist materials may trap some of these photoresist materials similar to the foam trapping the levelers. Frothing this electroplating solution and removing the foam may therefore remove some of the unwanted photoresist materials from the electroplating solution and thus improve plating performance. The above techniques and apparatuses are also applicable to various electroplating solutions, such as those that include and may be used for plating copper, nickel, tin, SnAg, gold, palladium, and cobalt. For example, some TSV filling chemistries may use plating solutions having copper, cobalt, and nickel; some damascene electroplating use plating solutions having copper and cobalt; and through resist plating (e.g., plating onto wafers with a photoresist) may use plating solutions having copper, nickel, tin, SnAg, gold, palladium, and cobalt.

Experimental Results

Figure 9:
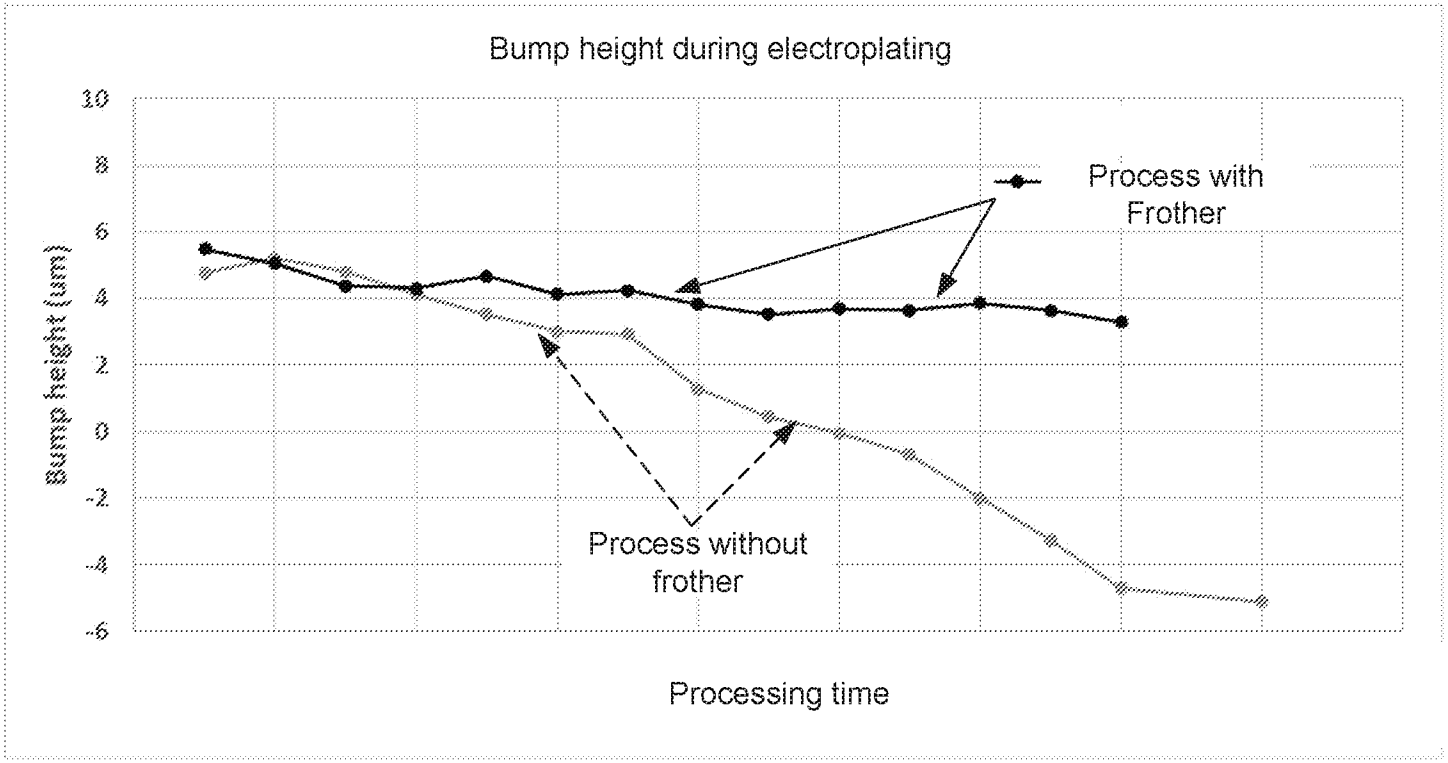
FIG. 9 depicts a graph of wafer via bump heights for two electroplating processes.

Using the above techniques and apparatuses improves the electroplating performance of an electroplating system by removing the unwanted byproducts. As stated above, it is commonly known in the art that the TSV bump height of a filled via provides an indicator of electroplating performance and electroplating solution degradation caused, in some instances, by the presence of unwanted leveler byproducts. Bump heights are measured with respect to the surface of the wafer such that, for example, a bump height of 4 micrometers (μm) is a via filled 4 μm above the surface of the wafer. As the leveler byproducts accumulate in the electroplating solution during electroplating of one or more wafers, the bump heights decrease over time until they reach an unacceptable level. In some embodiments, the desired bump heights are about 4 μm, +/−1 μm. FIG. 9 depicts a graph of wafer via bump heights for two electroplating processes; the horizontal axis is unitless processing time and the vertical height is bump height in μm. The first electroplating process does not have a frother and over time the bump height decreases to 0 μm and less than 0 μm, indicating there is a degradation of the electroplating fill process because the vias are not being completely filled to the top of the wafer. The second electroplating process utilizes a frother as described herein to froth the electroplating solution, generate the foam which traps the leveler byproducts, and remove the foam. As can be seen, using the frother maintains the desired electroplating bump height of 4 μm+/−1 μm much longer than the electroplating process without the frother.

Figure 10A:
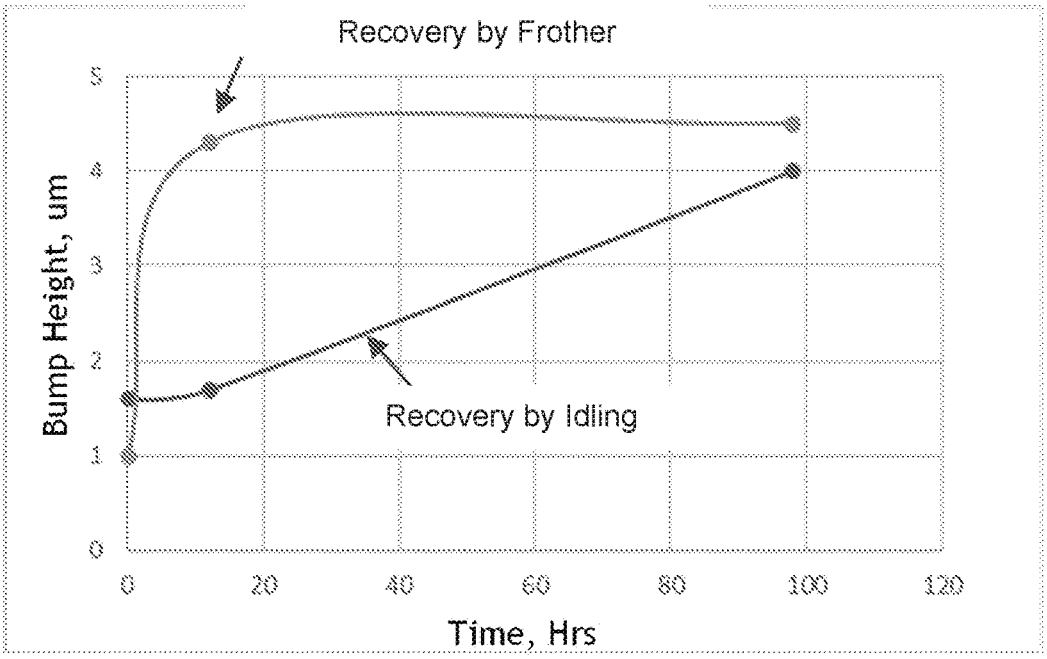
FIG. 10A depicts a graph of recovery times for two electroplating solutions and FIG. 10B depicts cross-sectional side views of a via on two wafers.
Figure 10B:
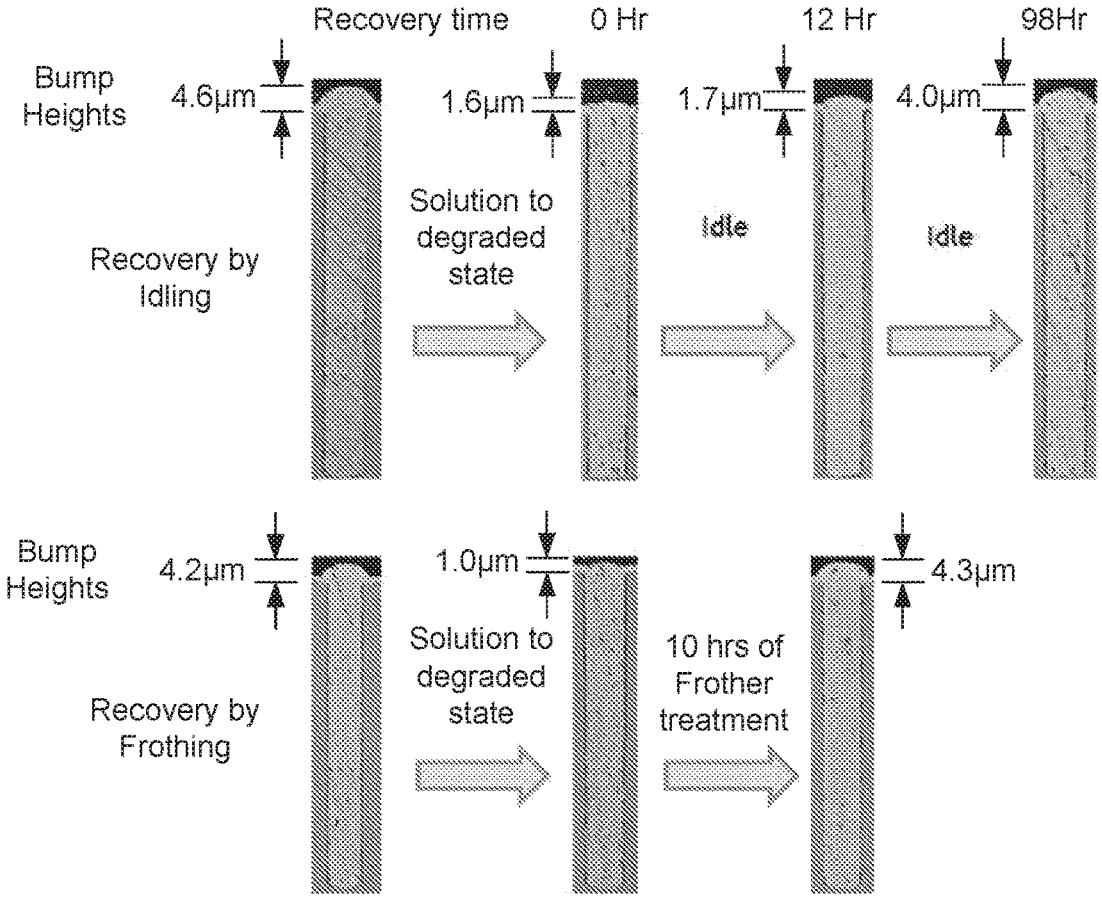

The above techniques and apparatuses also improve the recovery time for an electroplating solution which may improve throughput as well as electroplating performance. In many traditional electroplating systems, the electroplating solution may recover and return to desirable levels of byproduct by idling the electroplating solution, i.e., allowing the solution to remain at rest, over time. Using the above frothing techniques and apparatuses reduced the recovery time of an electroplating solution, thereby allowing for quicker use of the electroplating solution for electroplating processes and improving throughput, and reducing the waste of the electroplating solution. FIG. 10A depicts a graph of recovery times for two electroplating solutions and FIG. 10B depicts cross-sectional side views of a via on two wafers. In FIG. 10A the horizontal axis is time in hours and the vertical axis is bump height in μm and as can be seen, idling the electroplating solution has a recovery time of approximately 98 hours (hrs) for it to reach the desirable bump height of about 4 μm. In FIG. 10B, the bump heights during this idling recovery time at 0 hrs, 12 hrs, and 98 hrs are seen at 1.6 μm, 1.7 μm, and 4.0 μm, respectively. In is contrast, as seen in FIGS. 10A and 10B, using the frother causes the electroplating solution to recover in approximately 10 Hr.

The term "wafer," as used herein, may refer to semiconductor wafers or substrates or other similar types of wafers or substrates.

It is also to be understood that the use of ordinal indicators, e.g., (a), (b), (c), . . . , herein is for organizational purposes only, and is not intended to convey any particular sequence or importance to the items associated with each ordinal indicator. For example, "(a) obtain information regarding velocity and (b) obtain information regarding position" would be inclusive of obtaining information regarding position before obtaining information regarding velocity, obtaining information regarding velocity before obtaining information regarding position, and obtaining information regarding position simultaneously with obtaining information regarding velocity. There may nonetheless be instances in which some items associated with ordinal indicators may inherently require a particular sequence, e.g., "(a) obtain information regarding velocity, (b) determine a first acceleration based on the information regarding velocity, and (c) obtain information regarding position"; in this example, (a) would need to be performed (b) since (b) relies on information obtained in (a)-(c), however, could be performed before or after either of (a) or (b).

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein.

Certain features that are described in this specification in the context of separate implementations also can be implemented in combination in a single implementation. Conversely, various features that are described in the context of a single implementation also can be implemented in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. An electroplating system comprising:

an electroplating cell configured to contain an anode and an electroplating solution;

a wafer holder configured to support a wafer within the electroplating cell;

a reservoir configured to contain at least a portion of the electroplating solution;

a recirculation flowpath that fluidically connects the reservoir and the electroplating cell, wherein the recirculation flowpath includes a pump and is configured to circulate the electroplating solution between the reservoir and the electroplating cell;

a frother fluidically connected to one or more of: the electroplating cell, the reservoir, and the recirculation flowpath; and a container fluidically connected to one or more of: the electroplating cell, the reservoir, or the recirculation flowpath, and configured to receive and hold a first volume of the electroplating solution, wherein:

the frother is configured to:

generate bubbles in the electroplating solution in the container when the electroplating solution is present in the container, interfaced with the frother, and the frother is activated, and generate a foam in the container which traps a byproduct of electroplating, the container has:

a foam exit port configured to allow the foam in the container to exit the container through the foam exit port, and a fluid outlet lower in elevation than the foam exit port, and the electroplating system is configured to remove the foam with the byproduct trapped therein from the electroplating system through the foam exit port in an unaided manner, and the foam is configured to flow out of the container with the assistance of gravity and/or a pressure of the foam in the container.

2. The electroplating system of claim 1, wherein the frother comprises at least one of: an aeration stone, one or more jets, one or more nozzles, a propeller, and an impeller.

3. The electroplating system of claim 2, wherein:

the frother comprises the aeration stone, and the aeration stone is comprised of a material compatible with the electroplating solution.

4. The electroplating system of claim 3, wherein the material includes one or more of: a high-density polyethylene (HDPE), a polypropylene (PP), and polytetrafluoroethylene (PTFE).

5. The electroplating system of claim 4, wherein a porosity of the material is between about 1 millimeter and about 1 micron.

6. The electroplating system of claim 3, further comprising a gas source fluidically connected to the frother and configured to flow a gas to the aeration stone.

7. The electroplating system of claim 1, further comprising a foam generating unit that includes the container and the frother, wherein the foam generating unit is fluidically connected to one or more of: the electroplating cell, the reservoir, or the recirculation flowpath.

8. The electroplating system of claim 1, wherein the container is physically separate from, but fluidically connected to, one or more of: the electroplating cell, the reservoir, or the recirculation flowpath.

9. The electroplating system of claim 1, wherein the container is at least partially positioned in one of: the electroplating cell, the reservoir, or the recirculation flowpath.

10. The electroplating system of claim 1, wherein the container is fluidically interposed between the electroplating cell and the reservoir.

11. The electroplating system of claim 1, wherein the frother comprises a propeller or an impeller.

12. The electroplating system of claim 1, wherein:

the container includes a fluid inlet, and the foam exit port is higher in elevation than the fluid inlet.

13. The electroplating system of claim 1, further comprising a controller configured to control the frother, wherein the controller comprises control logic for:

causing the electroplating solution to flow into the container and be held by the container, and causing the frother to generate bubbles in the electroplating solution held in the container.

14. The electroplating system of claim 13, further comprising one or more inlet valves configured to control flow of the electroplating solution into the container, wherein:

the controller is further configured to control the one or more inlet valves, and the controller further comprises control logic for causing the one or more inlet valves to open to allow the electroplating solution to flow into the container.

15. The electroplating system of claim 14, wherein:

the system is further configured such that the electroplating solution flows into and out of the container through a common flowpath, the one or more inlet valves are configured to control flow of the electroplating solution into the container through the common flowpath, the one or more inlet valves are further configured to also control flow of the electroplating solution out of the container through the common flowpath, and the controller further comprises control logic for causing the one or more inlet valves to close to allow the container to hold the electroplating solution in the container.

16. The electroplating system of claim 14, further comprising one or more outlet valves configured to control flow of the electroplating solution out of the container, wherein:

the controller is further configured to control the one or more outlet valves, and the controller further comprises control logic for:

causing the one or more outlet valves to close to allow the container to hold the electroplating solution in the container, and causing the one or more outlet valves to open to allow the electroplating solution to flow out the container.

17. The electroplating system of claim 1, wherein:

the electroplating system is configured to hold a total working volume of electroplating solution, and the container is configured to hold up to 5% of the total working volume of electroplating solution.

18. The electroplating system of claim 1, further comprising a controller configured to control the frother, wherein the controller comprises control logic for causing the frother to generate bubbles in the electroplating solution during one or more time periods when the electroplating solution is present in the electroplating system and interfaced with the frother.

19. The electroplating system of claim 18, wherein the controller further comprises control logic for:

causing the frother to generate bubbles in the electroplating solution when the electroplating solution is present in the electroplating system and interfaced with the frother for a first time period, and causing the frother to repeat the generation of bubbles at a first time interval.

20. The electroplating system of claim 18, further comprising a power supply electrically connected to the wafer holder and the electroplating cell, wherein:

the power supply is configured to apply a voltage to a wafer held by the wafer holder, the controller further comprises control logic for:

causing the power supply to apply a voltage to a wafer held by the wafer holder and the electroplating cell, and measuring a voltage potential between the wafer and the electroplating cell, and the causing the frother to generate bubbles in the electroplating solution is further based, at least in part, on the measured voltage.

21. The electroplating system of claim 20, wherein:

the controller further comprises control logic for determining a change in the voltage potential between the wafer and the electroplating cell, and the causing the frother to generate bubbles in the electroplating solution is further based, at least in part, on the determined change in the voltage potential.

22. The electroplating system of claim 1, further comprising a controller configured to control the frother, wherein the controller comprises control logic for causing the frother to continuously generate bubbles in the electroplating solution during electroplating of a wafer.

* * * * *